United States Patent [19]

Bylo

[11] 4,072,120

[45] Feb. 7, 1978

[54] MARINE TRANSPORT

[76] Inventor: John J. Bylo, 7272 Willoughby Ave., Los Angeles, Calif. 90046

[21] Appl. No.: 649,645

[22] Filed: Jan. 16, 1976

Related U.S. Application Data

[60] Division of Ser. No. 439,375, Feb. 4, 1974, Pat. No. 3,934,532, which is a continuation-in-part of Ser. No. 187,537, Oct. 7, 1971, Pat. No. 3,793,974, which is a continuation-in-part of Ser. No. 794,938, Jan. 29, 1969, abandoned.

[51] Int. Cl.[2] ..... B63B 27/00

[52] U.S. Cl. ..... 114/72; 214/14

[58] Field of Search ..... 114/77 R, 77 A, 72, 114/258–260; 214/12, 14, 13

[56] References Cited

U.S. PATENT DOCUMENTS

| | | | |
|---|---|---|---|
| 1,001,170 | 8/1911 | Sayer | 114/72 |
| 3,139,197 | 6/1964 | Bylo | 214/12 |

*Primary Examiner*—Trygve M. Blix

*Assistant Examiner*—Stuart M. Goldstein

*Attorney, Agent, or Firm*—Christie, Parker & Hale

[57] ABSTRACT

A marine transport system encompasses at least three ports. A plurality of modular hold units are releasably engageable with any one of a plurality of vessels and are so sized that, when loaded with cargo, each hold unit consumes a substantial fraction of the load-carrying capacity of any one of the vessels. A dock facility is located in each port for supporting a hold unit, independently of any of the vessels, so that cargo can be worked into and out of the hold unit through at least one side of the hold unit. The hold units are loaded into and removed from the docks by ballasting a vessel up or down into or out of load-transferring relation to a hold unit. Each vessel is arranged to operate normally only between two adjacent ports in the system. To move a hold unit between two non-adjacent ports, the hold unit is transferred by use of the corresponding dock facility, from vessel to vessel at each intermediate port so as to be passed from vessel to vessel.

13 Claims, 20 Drawing Figures

19
18
17
16
10
11
15
14
13
22
20
38
37
104
103
102
105
100
12
10
101
24
22
20
23

19
19
22
32
34
73
74
71
130
131
132
30
B

MARINE TRANSPORT

CROSS-REFERENCE TO RELATED APPLICATIONS

This application is a division of application Ser. No. 439,375 filed Feb. 4, 1974, which issued Jan. 27, 1976 as U.S. Pat. No. 3,934,532. Application Ser. No. 439,375 was a continuation-in-part of copending application Ser. No. 187,537 filed Oct. 7, 1971, which application was filed as a continuation-in-part of prior (now abandoned) application Ser. No. 794,938 of Jan. 29, 1969. Application Ser. No. 439,375 described the same subject matter as is described in one or both of its predecessor applications. U.S. Pat. No. 3,793,974 has been issued upon application Ser. No. 187,537.

BACKGROUND OF THE INVENTION

1. Field of the Invention

This invention relates to marine transport systems and to procedures and structures in furtherance thereof. More particularly, the invention relates to a marine transport system in which modularization of cargo holds, docks, and transport vessels is maximized, the cargo holds preferably defining the entire cargo carrying capacity of a given vessel in the system and being interchangeable between vessels.

2. The State of the Art

At the present time, transport of cargo by water is, as a general rule, the most economical mode of transport available. In many instances, however, the cost differentials between sea and land transport, or between sea and air transport, in combination with the time differentials similarly involved, render land or air transport preferable to sea transport. If the cost of sea transport can be substantially reduced, the use of sea transport in preference to land or air transport would be increased to the advantage of the substantial maritime investment in the nation, as well as to the long term military advantage of the country.

The most significant single factor contributing to the total cost of transport of goods and materials by sea lies in cargo-handling expense. In break-bulk shipment of cargo by sea, wherein individual containers or small combinations or pallets of individual boxes, bags or other containers are loaded separately onto the transport vessel, manual handling of cargo occurs at many different points in the shipping process. In break-bulk shipment procedures, cargo is manually assembled and classified at a warehouse such as a manufacturers' warehouse or cartage broker's warehouse. Next the cargo is transferred to surface transport vehicles, another cargo handling operation, for transport to a transit shed located in the dock area. Upon arrival of the vehicle at the transit shed, the cargo is again handled as it is transferred from the vehicle to storage locations in the transit shed. Subsequently, the cargo is transferred from the transit shed to dockside; in this process, the cargo is handled both upon removal from the transit shed and upon deposit at dockside. Still later, the cargo is removed from dockside to the cargo hold of the ship by the use of the cargo handling gear located either at dockside or upon the vessel; this procedure involves two additional cargo handling operations. Upon deposit of the cargo within the vessel, it is frequently moved within the vessel by stevedores since the cargo handling gear of a conventional shelterdeck vessel, for example, does not provide access to all cargo stowage locations of the vessel. Upon arrival of the vessel at its destination, a reverse cargo handling procedure is involved. Therefore, it is seen that approximately sixteen separate cargo handling procedures are involved in the marine transport of cargo from original source to ultimate destination. Each cargo handling operation involves manual labor performed with or without the assistance of mechanized cargo handling devices. It is well known that labor cost, rather than equipment cost, is the single most expensive item in any process performed practically anywhere in the world at the present time, particularly so in the United States.

In view of the above-described uneconomical characteristics of break-bulk cargo handling procedures, and in an effort to reduce the overall cost of marine transport, advances in the containerization of cargo have been realized in the United States as well as abroad. By these advances, the cargo handling process from manufacturer's warehouse to ship and from ship to destination warehouse has been simplified by the elimination of the transit shed. In this process, cargo is transferred directly from the manufacturer's warehouse, e.g., to dockside in a container which conventionally is the cargo van of a tractor-drawn cargo trailer (semi-truck trailer), the van being removable from its supporting wheels in the most advanced containerization operations presently in commercial use. These truck vans ultimately are loaded directly aboard the vessel, but in the interim between dispatch from the manufacturer's warehouse and loading aboard ship or barge, the vans must be assembled in a staging area adjacent to dockside from which they are later moved to the vessel. According to current containerization practices, cargo handling procedures involving manual labor occur fourteen times, as opposed to sixteen times with break-bulk cargos, in transport of a given item of cargo from manufacturer's warehouse or the like to destination warehouse. The basic practical advantage over break-bulk cargo handling techniques of containerization systems of the type described above is the reduction in the extent to which individual cargo packages are handled. That is, greater quantities of cargo are dealt with in each cargo handling operation with the result that handling costs per individual commercial unit of cargo are reduced to a greater extent than the reduction in the total number of cargo handling operations involved.

SUMMARY OF THE INVENTION

This invention provides a unique and highly efficient marine transport system which takes utmost advantage of the structures and methods described in my prior U.S. Pat. Nos. 2,371,149 and 3,139,197 and 3,349,742, if desired.

My prior patents 2,371,149 and 3,139,197 describe marine transport structures in which containerization of the cargo is maximized in that the vessel described in each of these patents features a cargo hold volume which is detachable as a unit from a self-propelled buoyant base which is basically the machinery and non-cargo-carrying aspect of a marine vessel. These prior patents teach that the cargo hold unit may be transferred to or received from a suitable dock structure, configured to cooperate with the hold unit, merely by ballasting the vessel per se into and out of mating engagement with the cargo hold unit. In practical effect, then, the cargo hold unit functions much like a movable transit shed or warehouse, reference in this respect being had to the foregoing description of conventional break-bulk cargo handling techniques; it will be understood, however, that the cargo hold unit does not comply with the technical definition of a transit shed as concerns aisle spaces and the like. Therefore, in a complete routing of cargo pursuant to the system contemplated herein, cargo is handled once to transfer cargo from a manufacturer's warehouse to a surface vehicle, a second time to transfer the cargo from the vehicle to the cargo hold unit, and twice again in the transfer of the cargo from the hold unit to a surface vehicle at the destination port and from the surface vehicle to the destination warehouse; in total, then, the present cargo handling system contemplates only four cargo handling operations in which manual effort is involved to any significant respect. In the system provided by this invention, handling costs attendant to transfer of a hold unit to or from the transit vessel involves minimum personnal and manual effort and is, therefore, insignificant in terms of contribution to the total cost of shipment of cargo by this system.

In addition to the foregoing direct cost saving advantages provided by this invention, additional advantages are obtained in that, by maximizing the volume of the container (the hold unit may be regarded as the ultimate container) to a degree far beyond that contemplated by existing containerization systems, the cost of the container per ton of cargo capacity is considerably lower than the corresponding cost associated with existing truck-type container modules. Further, inasmuch as the time involved in transferring the hold unit to a vessel like those described in the earlier two of my three above-mentioned patents is small, the vessel contemplated by this system is in productive motion from port to port for a considerably greater percentage of its useful life than is a container vessel of the type presently enjoying commercial exploitation.

The basic element or module of the present marine transport system is the ship-size container or cargo hold unit. The hold unit is standarized (i.e., modularized) in certain of its basic external dimensions and configurations, but its internal structure and remaining external features may be varied to accord with the specific requirements of particular commodities and cargo types. That is, while a cargo hold unit specifically tailored for use in shipping newsprint, for example, may appear externally to be essentially identical to a cargo hold unit tailored specifically for the transport of, say, bananas, internal cargo handling devices and environmental control facilities would be markedly different between these two basic containers. If desired, a cargo hold unit for use in a system of this invention may be constructed essentially as an automated warehouse for essentially automatic receipt and discharge of individual cargo units.

Further, the system contemplated by this invention permits variation in the design and outfitting of the vessels of the system to comply with the requirements of the ports between which they would normally operate, and also to conform to the particular sea-keeping criteria pertinent to the routes along which the particular vessels would normally be operated. In this regard, it is a feature of this invention that a given transit ship, expecially where this invention serves commercial rather than military purposes, would run cyclically between two adjacent ports, say, from Los Angeles to San Francisco, Calif., and that a separate vessel would be operated on a shuttle route between San Francisco and Portland, Oreg., for example. In essence, then, the system of this invention contemplates that individual transit vessels would merely cycle back and forth between adjacent ports on a particular shipping route, whereas the cargo hold units may be moved serially along a greater route from port to port, picking up or discharging cargo in each port as desired. Such usage of a given transit vessel between only two specified ports has significant and substantial benefits in terms of shipboard operating personnel; ship crews may spend most of their nights ashore rather than aboard ship, thereby permitting a simplification of the crew facilities aboard the transit vessel and providing a substantial net reduction in operating cost to the ship owner.

Further, the system of this invention contemplates the use of specially designed in-port vessels suited for receiving a cargo hold unit from a transit dock facility located in an outer harbor, for example, to a working dock facility located at the inner harbor, at which location cargo is actually worked, i.e., taken from or placed in the individual cargo hold unit. The in-port transit vessel may have propulsion machinery designed to produce a highly maneuverable, but rather low speed vessel, whereas the port-to-port transit vessels may be designed and equipped for maximum speed and sea-keeping ability, but only nominal maneuverability. The transfer dock facility which forms the interface between the port-to-port transit vessel and the in-port transfer vessel preferably is located at the outer harbor of a given port and is configured to permit economic usage thereof by both the transit vessel and the in-port vessel. The working dock facility at any given port need only be configured to mate with a particular in-port vessel and the standarized, molularly designed cargo units.

In the present system, therefore, it is seen that the cargo hold unit is the basic module involved, and that the transit vessels, in-port vessels, and the transfer dock and the working dock facilities are all cooperatively structured and arranged to cooperate with the cargo hold unit but may otherwise be varied in structure, proportions and arrangement to meet the peculiar limitations imposed by their own environment and specific use.

GENERAL RESUME OF CLAIMS

Generally speaking, this invention involves methods of transporting cargo by water. One method, adapted for commercial usages, includes providing a plurality of modular cargo hold units of generally uniform external configuration and dimension over at least their lower portions. The method includes establishing an overall route over which cargo is to be moved so that the route includes at least three ports; the overall route is subdivided into subroutes which connect each adjacent pair of ports, such that at least one port is the terminus for two adjacent subroutes. There is provided for each subroute a self-propelled shuttle vessel which is configured to mate with and to support at least any one of the hold units. Each shuttle vessel is sized relative to a hold unit so that a loaded hold unit constitutes a substantial fraction of the load carrying capacity of the vessel. Each shuttle vessel is configured and arranged for operation along its subroute. The method further includes the step of providing in each port a dock facility which is arranged for receiving and supporting a hold unit independently of any of the vessels. In operation, the method includes loading into a hold unit at an originating port only cargo destined for a given different non-adjacent port in the overall route. The loaded hold unit is moved between the originating port and the destination port on the route via one or more intermediate ports; this is accomplished by a procedure which comprises the steps of (a) moving the hold unit by a first shuttle vessel along a first subroute from the originating port to a first intermediate port, (b) transferring the hold unit from the first shuttle vessel to the dock facility in the first intermediate port, (c) transferring the hold unit from the dock facility in the first intermediate port to a second shuttle vessel for the subroute which is adjacent the first subroute, and (d) moving the hold unit toward the destination port by operating the second vessel along its subroute and by repeating steps (b) and (c) in each intermediate port between the first intermediate and the destination ports so that the hold unit is moved along each subroute between the originating and destination ports by the shuttle vessel for each subroute. Cargo contained in a hold unit is removed from the hold unit only on arrival of the hold unit at the destination port for which all cargo in the hold unit is destined.

This invention also provides a method of establishing and operating a military logistical support operation with which the above-summarized marine transport method is compatible.

DESCRIPTION OF THE DRAWINGS

The above-mentioned and other features of this invention are more fully set forth in the following detailed description of preferred embodiments of the invention, which description is presented with reference to the accompanying drawings, wherein:

FIG. 13 is an elevation view of the dock of FIG. 10 installed adjacent an unimproved beach or the like;

FIG. 17 is a perspective view of a military transit vessel and a pair of cargo hold units specifically suited for military application;

DESCRIPTION OF THE ILLUSTRATED EMBODIMENTS

Figure 1:
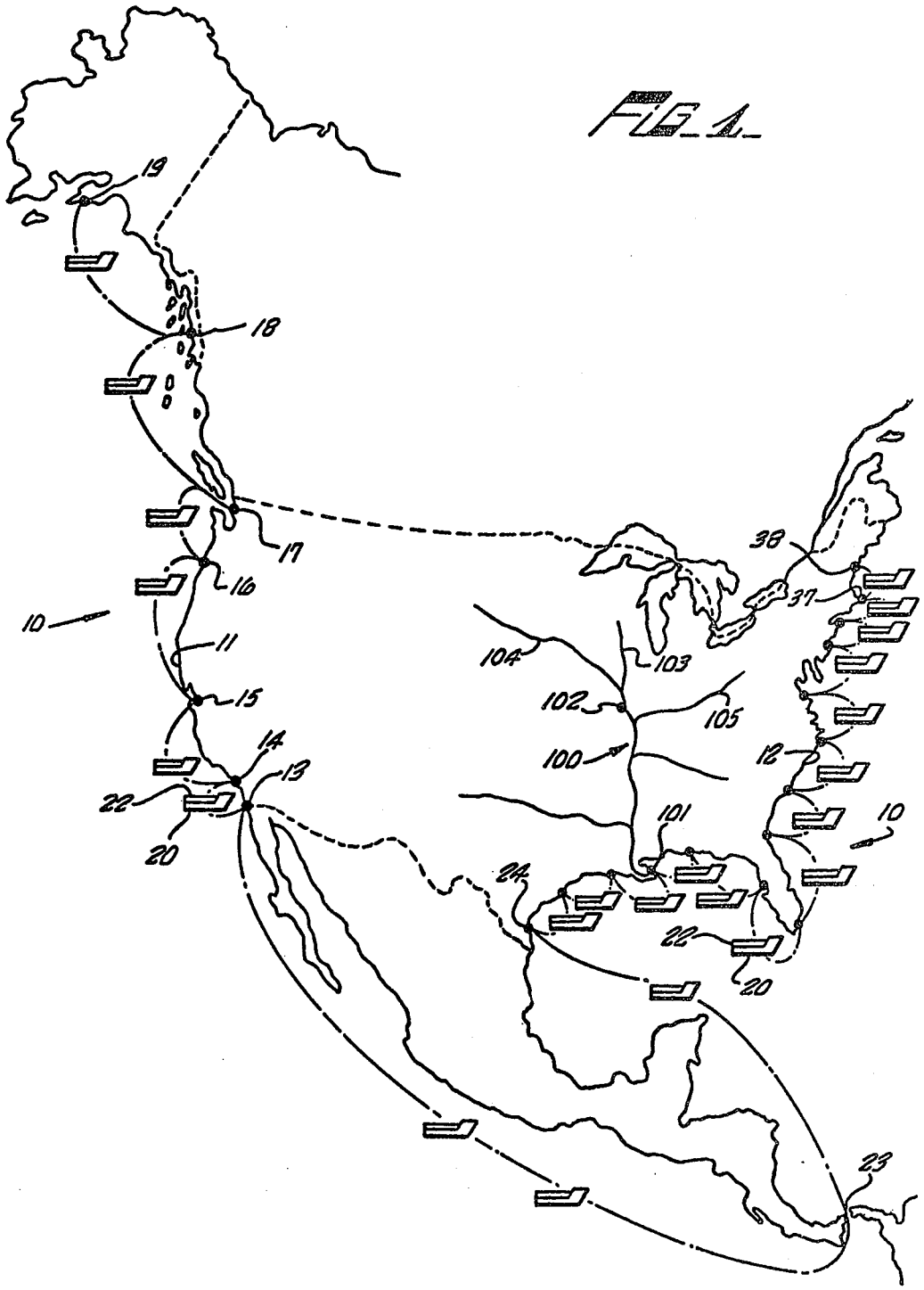
FIG. 1 illustrates, relative to the United States, a commercial marine transport system according to this invention.

FIG. 1 illustrates the general functioning of a commercial marine transport system 10 serving the West Coast 11 and the East Coast 12 of the United States. As will be made clear from the following description, this system is not restricted to service of coastal ports, nor is it restricted only to commercial service. The system also may service inland areas via rivers, and it may be combined with military transport systems operating according to similar principles as set forth in the following description. With reference to the West Coast of the United States, reference numerals 13–19 designate, respectively, the following ports relative to which system 10 is described in detail:

13: San Diego, Calif.
14: Long Beach-Los Angeles, Calif.
15: Greater San Francisco Bay Area, Calif.
16: Astoria-Portland, Oreg.
17: Seattle, Wash. and Vancouver, B.C.
18: Juneau, Alaska
19: Seward-Anchorage, Alaska It will be understood that more or less ports on the West Coast of the United States may be included in system 10 as desired, the ports listed above having been identified merely for the purposes of example.

Figure 9:
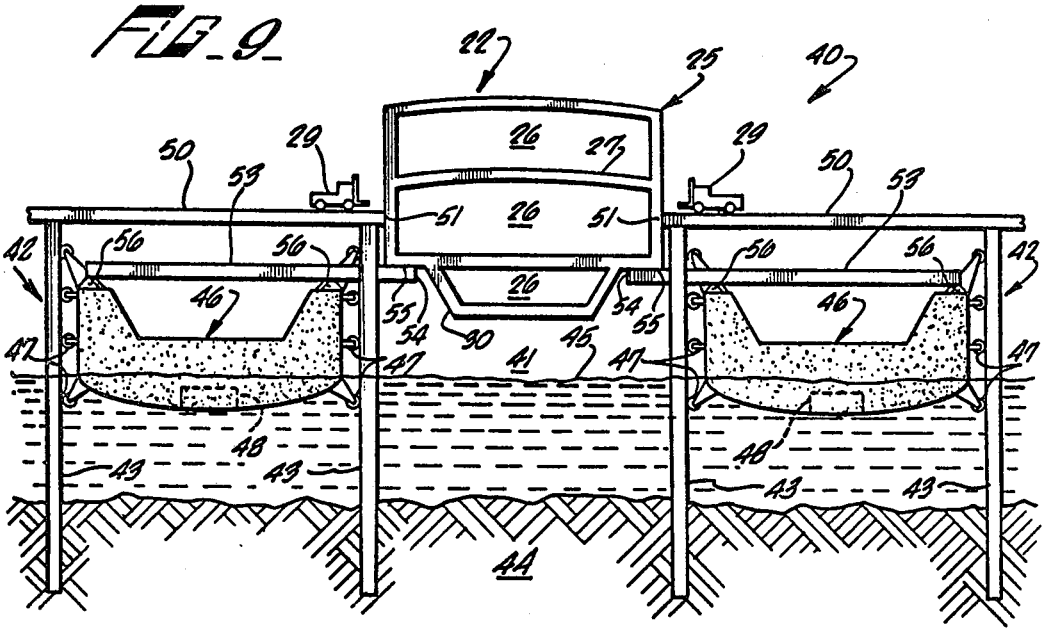
FIG. 9 is an elevation view of a working dock facility according to this invention.
Figure 3:
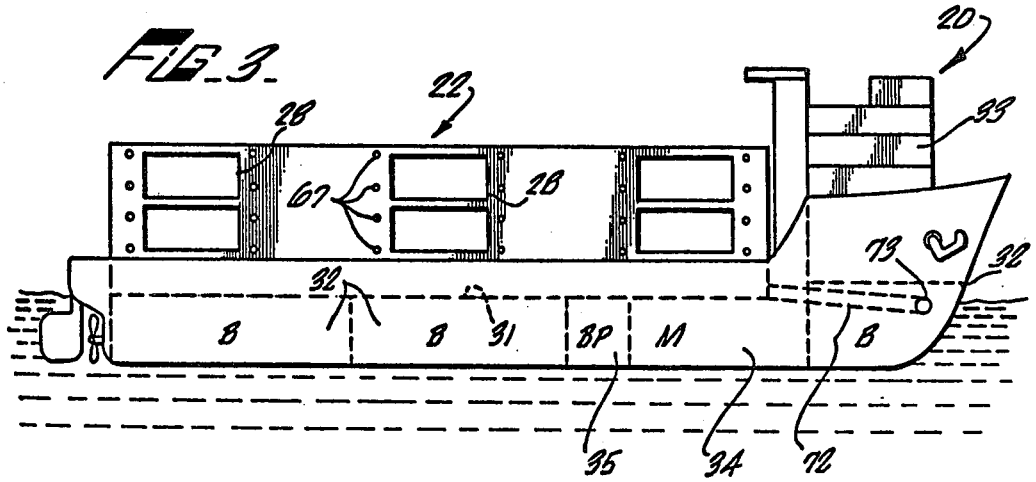
FIG. 3 is an elevation view of a port-to-port transit vessel for use in the system depicted in FIGS. 1 and 2.

As suggested above, system 10 includes a plurality of port-to-port transit or shuttle vessels 20 (see FIG. 3) which cooperate with a greater plurality of modular, i.e., generally dimensionally and functionally standardized, cargo hold units 22 (see FIGS. 3 and 9). The system also includes, in each port comprehended by the system, at least one and preferably several working dock facilities, a transfer dock facility, and an in-port transfer vessel. At least as many transit vessels 20 are provided as there are shipping runs between adjacent ports. That is, FIG. 1 illustrates a transport system comprehending a total of twenty-two ports which correlate to twenty-one adjacent pairs of ports. Additional transit vessels may be required on shipping runs where cargo traffic is particularly heavy, or on runs where the distance between adjacent ports is large, as on the shipping run via Panama Canal 23 between San Diego 13 and Corpus Christi, Tex. 24.

Cargo hold units 22 of system 10 are all standardized as to selected external dimensions, arrangements and configuration. Each hold unit defines a structural shell 25 (see FIG. 9) which encloses a cargo space 26. The cargo space is horizontally subdivided by internal decks 27 within the shell, and closable access openings 28 (FIG. 3), sized to admit fork-lift trucks 29 or the like, are provided to the decks from the exterior of the shell.

Because certain of their external features are standardized, the hold units are modular in design.

Each hold unit defines means which cooperate with a transit vessel to secure the hold unit in place on the transit vessel during ocean passage of the vessel. As shown in FIG. 9, such means includes a rib 30 which depends from the lower extent of the hold unit, and which cooperates in a correspondingly contoured recess 31 (FIG. 3, and see also FIG. 19) within the deck of the transit vessel which supports the hold unit when the hold unit and the vessel are mated. The interior of the rib defines a portion of cargo space 26.

The cargo hold units are made as large as possible. Preferably the hold units have capacity to receive at least 5000 tons of average density cargo. The transit vessels are sized to be large enough to receive and support at least one cargo hold unit (see FIG. 3), to provide sufficient ballast capacity 32 that the vessel may be buoyantly raised and lowered into and out of engagement with a loaded cargo hold unit as described below, to provide suitable accommodations 33 for operating personnel, and to provide space for propulsive machinery 34 and ballast pumps 35. It is preferred that the majority of the transit vessels present in system 10 be like vessel 20 (FIG. 3), namely, a carrier for a single hold unit which, when mated with the vessel, defines the entire cargo carrying capacity of the vessel. The cargo hold unit, therefore, will be seen to resemble a movable cargo warehouse.

Figures 18, 19:
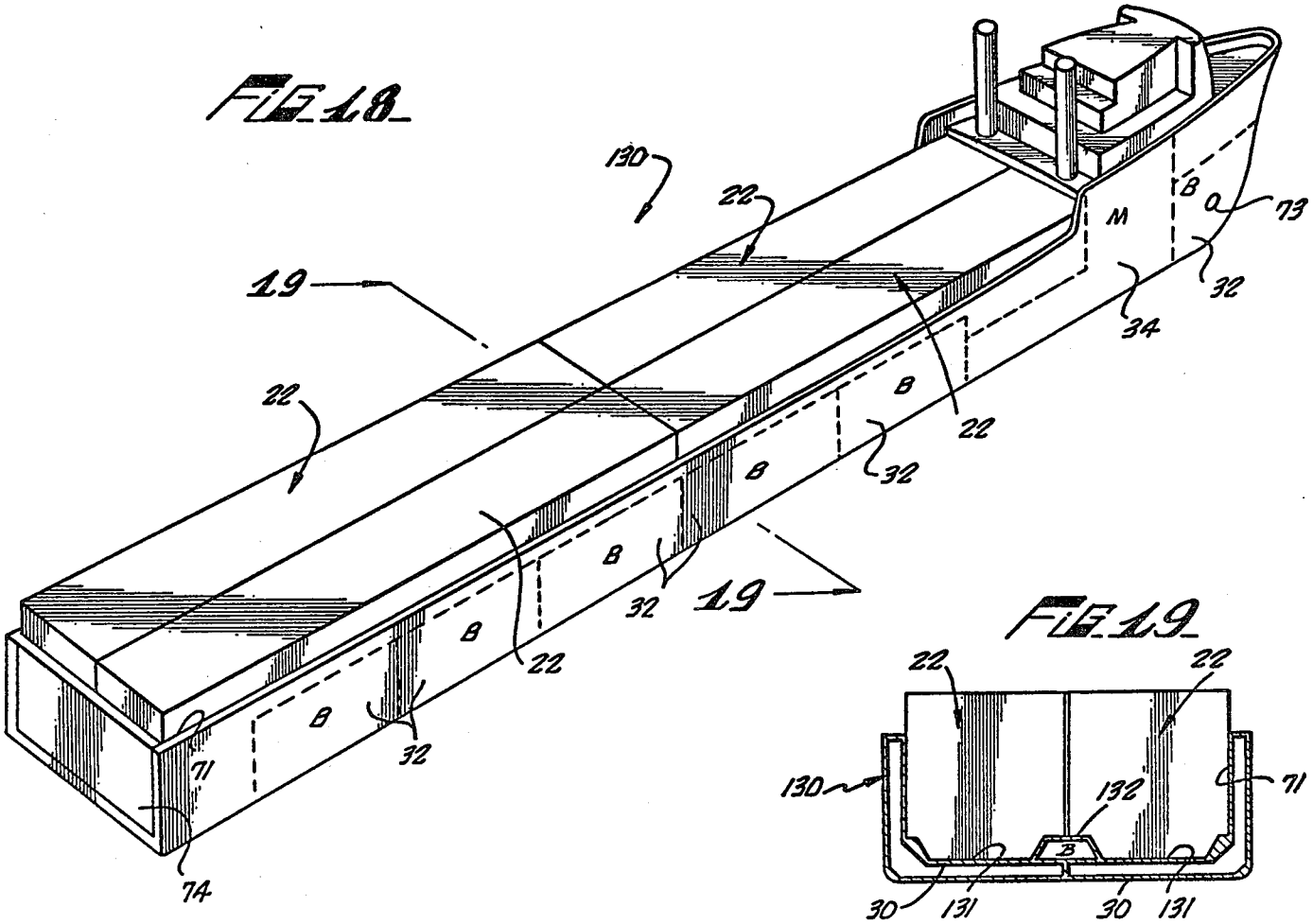
FIG. 18 is a perspective view of another multi-cargo hold unit transport vessel especially suited for military use in combination with cargo hold units of the type suited for commercial use as contemplated by FIG. 3.
FIG. 19 is a cross-sectional elevation view taken along line 19—19 of FIG. 18.

It will be understood from the following text that this invention also comprehends, in the context of a commercial transport system, port-to-port transit vessels capable of receiving a plurality of modular cargo hold units 22. Such multi-unit transit vessels may be used to advantage in servicing the San Diego to Corpus Christi segment of system 10, or the Seattle to Juneau segment of the system where the distance between adjacent ports greatly exceeds the distance between adjacent pairs of ports elsewhere in the system. FIG. 18 illustrates a multi-unit transit vessel 130 which may be used to advantage in system 10.

Each transit vessel, consistent with the requirement that it be standardized to mate with the modular cargo hold units, preferably is adapted specifically to the particular route along which it operates in system 10. Thus, the transit vessel which operates between, say, Los Angeles 14 and San Francisco 15 may possess different propulsion and maneuvering equipment, hull form, and personnel accommodations than the transit vessel which operates between, say, Boston 37 and Portland, Maine 38 in view of the different average sea and weather conditions and the peculiarities, such as effective water depth, of the harbors serviced.

Figure 2:
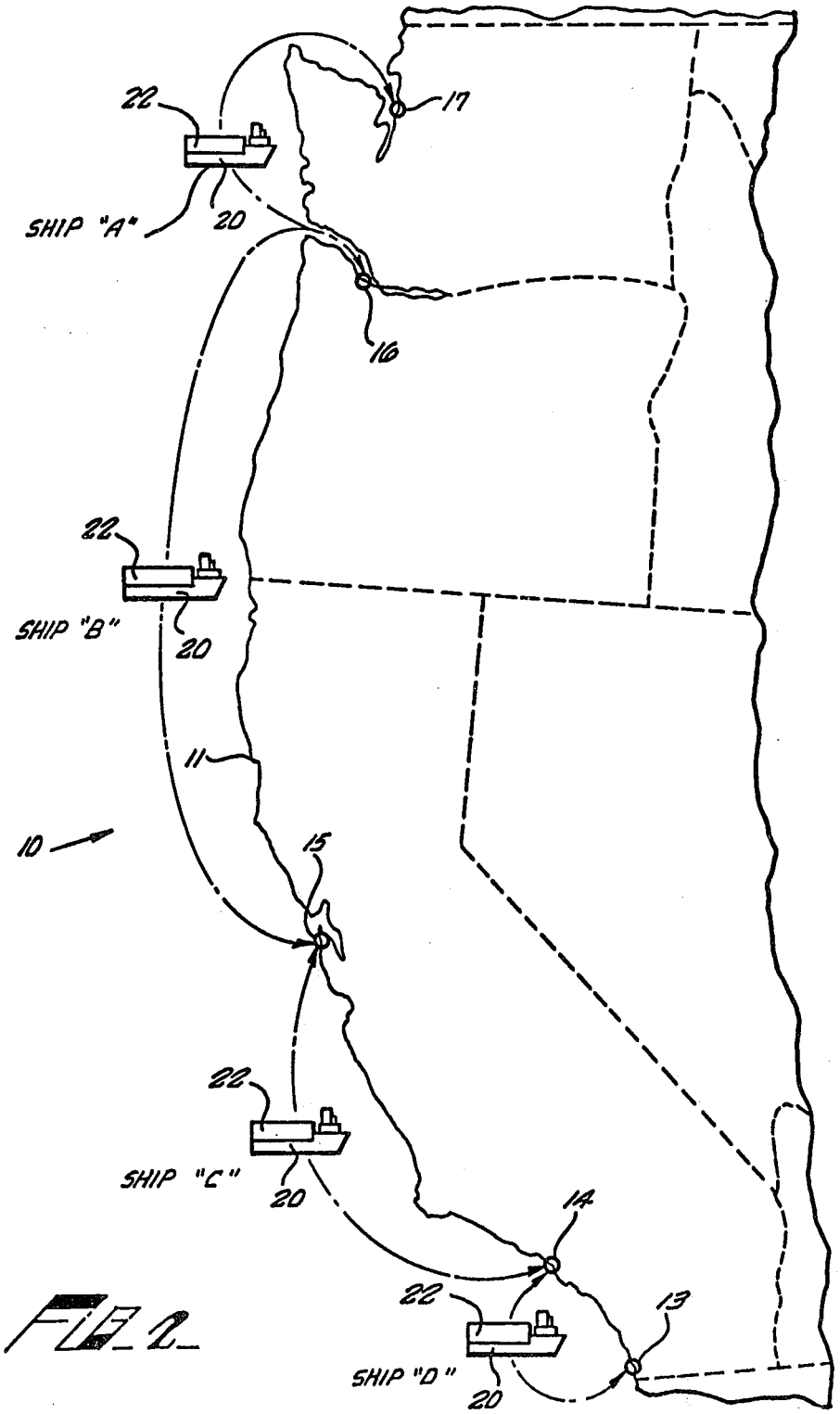
FIG. 2 is an enlarged illustration of the portion of FIG. 1 which pertains to the West Coast of the United States.

Referring still to FIGS. 1 and 2, and also to FIG. 9, each port serviced by system 10 includes at least one working dock facility 40, and it is preferred that each port be equipped with a plurality of such dock facilities. Preferably, the working dock facilities are located in an inner harbor area where surface vehicles may have ready access to the dock facilities; a working dock facility may constitute a portion of a manufacturing operation located within the port area. The term "working dock facility" is used to describe a dock structure where cargo is worked (loaded or unloaded) relative to a cargo hold unit engaged with and supported by the dock structure.

Working dock 40, shown in FIG. 9, defines a vessel slip 41 between two parallel piling arrays 42. The pilings 43 in each array are all vertical and are driven into harbor bottom 44 to have their upper ends located well above water surface 45. The pilings of each array preferably are arranged in two rows of pilings disposed parallel to the length of slip 41, which rows in each array are spaced apart a distance greater than the width of a ballastable buoyant unit 46 located between the rows. Each buoyant unit carries a plurality of rollers 47 which cooperate with the opposed faces of the pilings in the two rows of the corresponding array for maintaining the buoyant unit in place between the pilings and for guiding the buoyant unit in vertical movement along the pilings. The buoyant units are caused to move vertically in the dock structure by operation of ballast pumps 48 located in each unit, which pumps are operable to cause water to be pumped into or out of the units. If desired, each buoyant unit 46 may be defined by a midship vessel bottom section according to the disclosures of my prior U.S. Pat. No. 3,349,742; such a practice enables maximum possible standardization of the structures used in system 10 and thereby results in minimum cost to install and operate the system.

Piling arrays 42 are spaced sufficiently far apart that slip 41 is wide enough to accommodate a vessel, possibly a port-to-port transit vessel 20 but preferably an in-port transfer vessel 49 described below, which carries a cargo hold unit 22. An access deck 50 is supported by the upper ends of the pilings in each array, and preferably both decks 50 of the dock structure are located in a common plane. The access decks are sufficiently strong that they can support fork-lift trucks 29 and such other vehicles and equipment as may be used to work cargo in a hold unit engaged with the dock structure. It is preferred that the opposing edges 51 of the access decks be spaced apart a distance which is only slightly greater than the width of cargo hold unit 22.

Each buoyant unit 46 carries means which are engageable with a cargo hold unit to support the hold unit above water surface 45 upon removal from slip 41 of the vessel which conveyed the hold unit to the working dock facility. As shown in FIG. 9, each buoyant unit 46 carries a plurality of retractable beams 53 which are disposed transversely of the length of slip 41. The beams are movably mounted to the upper extent of each buoyant unit for movement between (1) a retracted position in which the adjacent ends 54 of the beams are disposed outwardly of access deck edges 51 from the slip, and (2) an extended position in which (a) the beams extend in cantilever fashion inwardly of the slip and (b) ends 54 of opposing beams are spaced apart a distance less than the width of a cargo hold unit but greater than the maximum width of the depending rib 30 of a cargo hold unit. In their extended position, the beams are arranged for supporting a cargo hold unit by engagement with the downwardly open marginal flange-like surfaces 55 of the hold unit outwardly of and parallel to rib 30. Suitable bearings 56 are disposed between the beams and the buoyant units to movably support the beams on the buoyant units.

Pilings 43 need have only sufficient strength to support access decks 50 and to withstand whatever lateral loads may be imposed upon the pilings by the buoyant units. The basic function of the pilings is to support decks 50 and to guide buoyant units 46. The pilings do not support the weight of the cargo hold unit, this function being served by the buoyant units.

It is preferred that the internal ballast spaces and the ballast machinery of buoyant units 46 be arranged so that the buoyant units may be controllably ballasted to impart desired conditions of trim (fore and aft inclination) and heel (transverse inclination) to the buoyant units. This capability is desired since this invention includes the provision of cargo hold units equipped with automatic or semi-automatic loading the unloading devices sensitive to gravity. That is, the cargo hold units may be fitted with gravity operated roller conveyors so that when the hold unit is tilted in one direction cargo is automatically induced to move within the hold unit toward access doors 28, and when tilted in the opposite direction cargo is moved in the hold unit away from the access doors, thereby to reduce the time and effort required to work cargo to or from the cargo hold unit.

System 10, the presently preferred commercial system-embodiment of this invention, also includes a transfer dock facility 58 at least one of which is located in each port encompassed by the system. It is preferred that the transfer dock facilities for each port be located in the outer harbor area of the port where the average water depth over the harbor bottom 44 is greater than in the inner harbor area. It is understood that an outer harbor area is within such breakwaters as may be associated with the particular port.

Figure 8:
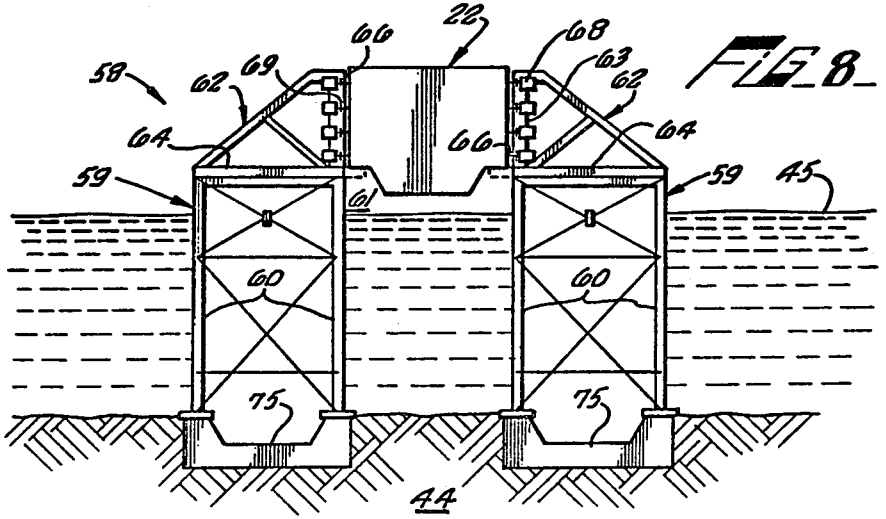
FIG. 8 is an end elevation view of a transfer dock facility for use in the system according to this invention.

Referring to FIG. 8, transfer dock facility 58 includes two piling arrays 59 which extend from the harbor bottom to above water surface 45. Each piling array is similar to a piling array 42 in that the individual pilings 60 thereof are arranged in parallel rows on opposite sides of an elongate slip 61 sized to receive either a port-to-port transit vessel 20 bearing a cargo hold unit or an in-port transfer vessel similarly loaded. The pilings, or vertical structural members of the transfer dock facility, are laterally braced along their length and support a pair of structural frameworks 62 above the water surface. The frameworks include a plurality of vertical members 63 located adjacent the slip, corresponding ones of which are spaced a distance slightly greater than the width of a cargo hold unit. Each piling array also supports a plurality of movable beams 64 disposed transversely of the length of the slip, which beams are similar to and perform the same function as beams 53 of working dock facility 40. The purpose of each transfer dock facility is to receive a cargo hold unit from a port-to-port transit vessel and to discharge a received hold unit to an in-port transfer vessel (and vice versa), the transfer vessel being used to move the hold unit to a selected working dock facility in the port.

As described above, it is desired that cargo hold units be engaged with and disengaged from a transit vessel by ballasting of the vessel. Where ballasting is to be accomplished entirely by the vessel, it is apparent that the cargo hold unit must be held stationary relative to the water surface as the vessel moves vertically into and out of supporting engagement with the hold unit; the transfer dock facility serves such a supporting function.

A plurality of horizontally disposed hold unit support pins 66 are reciprocally mounted to framework 62 along vertical members 63. The pins are disposed in a predetermined pattern which corresponds to the pattern in the exterior side walls of cargo hold unit 22 (see FIG. 3) of a corresponding number of pin receiving sockets 67 which are incorporated into the structure of the hold unit. Each pin is connected to an actuating device 68, and each pin cooperates with a guide element 69 which both constrains the pin to purely reciprocal movement and supports the pin relative to corresponding framework 62. Actuating devices 68 are all coupled to a common control mechanism so that the pins are moved toward or away from the slip in tandem. Pneumatic actuation devices for pins 66 are preferred over hydraulic actuation devices so that the pins cannot be withdrawn from sockets 67 until the load imposed upon the pins by cargo hold unit 22 reaches essentially zero value. That is, pneumatic actuation devices provide finer control than hydraulic devices over the forces against which the pins may be moved.

When transit vessel 20 enters slip 61 of transfer dock facility 58 carrying a cargo hold unit to be transferred to the dock facility, the vessel either has substantially maximum buoyancy or is unballasted while in the slip to have either maximum buoyancy or sufficient buoyancy that sockets 67 of the cargo hold unit are aligned with pins 66. Actuation devices 68 are operated to advance pins 66 into sockets 67, beams 64 at this time being disposed outwardly of the slip. The ballast pumps of the vessel are then operated to decrease the buoyancy of the vessel, thereby causing the vessel to settle in the water relative to the structure of the transfer dock facility. It is preferred that center well 71 of the transit vessel (see FIGS. 18 and 19) be placed into communication with the sea via a flooding duct 72 provided from the center well to the exterior of the vessel at its forward end as soon as the outboard end 73 of the flooding duct passes below the water surface. The entry of water into the vessel center well reduces the effective weight of the cargo hold unit on the transit vessel. In this connection, it is preferred that the lower extremity of the cargo hold unit be watertight so that water admitted to the vessel center well does not penetrate to the interior of the cargo hold unit. Ballasting of the transit vessel to reduce its net positive buoyancy is continued until the vessel sinks relative to the dock structure sufficiently that the entire load of the cargo hold unit is borne by pins 66 rather than by the transit vessel. The water admitted to the center well of the vessel to reduce the effective weight of the hold unit on the vessel also serves as additional ballast, enabling the vessel sinking process to be carried out with maximum possible speed.

Once the weight of the hold unit has been transferred to pins 66, sufficient load is imposed on the pins that they cannot be withdrawn from sockets 67 in the event of inadvertent operation of actuating devices 68. Nevertheless, as a safety precaution, beams 64 are extended under the marginal flange surfaces of the cargo hold unit as soon as the transit vessel has cleared sufficiently from the hold unit to permit the inner ends of the beams to be inserted under the hold unit. To facilitate removal of the transit vessel from under the hold unit, and also to minimize the amount of ballast which must be taken on by the transit vessel to enable it to clear the discharged hold unit, the stern of the vessel may be provided with a transom gate 74 (see FIG. 18) through which hold unit rib 30 may pass as the vessel is withdrawn from slip 61.

In order that the vessel may be disengaged from hold unit 22 by the process described above, it is necessary that the transit vessel have sufficient ballast capacity to be able to take on at least that weight of water equal to the maximum weight of the loaded cargo hold unit. Preferably the ballast capacity of the vessel is approximately 120% of the maximum cargo hold weight. It is also preferred, in order to have adequate stability in the loaded transit vessel during operation between ports of system 10, that the vessel run between ports at some partial ballast condition.

After depositing a cargo hold unit at transfer dock structure 58, the unloaded transit vessel moves to another transfer dock facility to pick up a loaded cargo hold unit by a procedure which is the reverse of the procedure described above. After taking on the other cargo hold unit, the vessel then departs for the other port of its route in system 10.

In view of the foregoing, it is apparent that transit vessels 20 operate as much as possible in shuttling cargo hold units between adjacent ports of system 10, thereby to serially advance the hold units from port to port in the system. The vessel is idle only those short intervals when it is either discharging or taking on a cargo hold unit in either of the ports between which it operates. As a result, the vessel is engaged in productive effort during substantially the entire length of its useful life; this fact is of extreme economic significance.

As shown in FIG. 8, it is preferred that pilings 60 be mounted at their lower ends to base assemblies 75. With this arrangement, the transfer dock facilities may be erected complete at a shipyard or the like and towed into place over the spot where they are to be installed. Base assemblies 75 are then flooded to cause the prefabricated units to sink into place on the harbor floor, following which the interiors of the base assemblies are filled with concrete or the like to securely anchor the assemblies in the harbor bottom. It is apparent, therefore, that transfer dock facilities may be erected rapidly and economically in the harbor of any port as to which system 10 is to be inaugurated.

Figure 4:
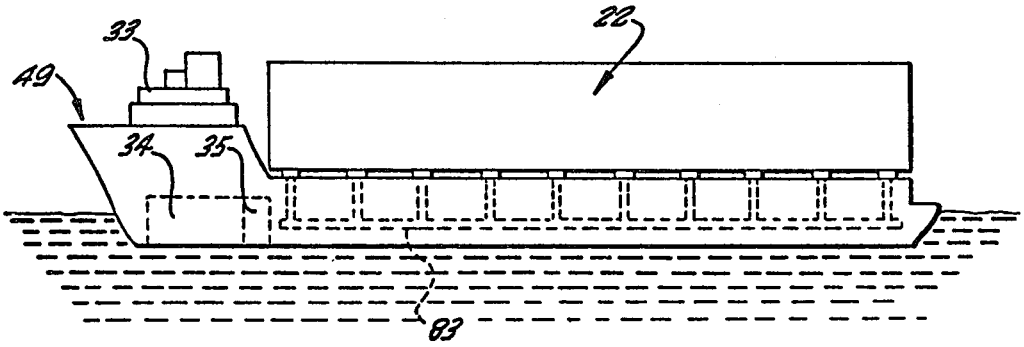
FIG. 4 is an elevation view of an in-port transfer vessel suited for use in the system of FIGS. 1 and 2.
Figure 5:
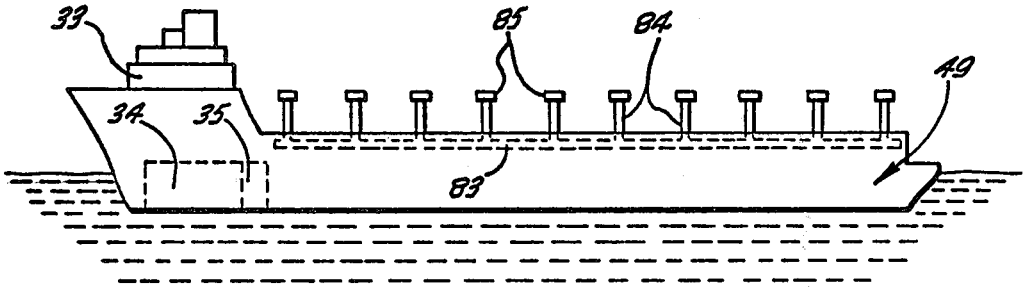
FIG. 5 is an elevation view of the vessel shown in FIG. 4 illustrating another stage in the operation of such vessel.
Figure 6:
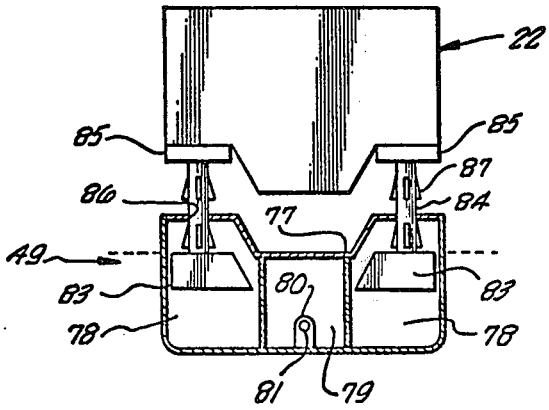
FIG. 6 is a fragmentary cross-sectional elevation view of the vessel shown in FIGS. 4 and 5.

A cargo hold unit preferably is moved from a working dock facility 40 to a transfer dock facility 58, or vice versa, by an in-port transfer vessel 49, shown in FIGS. 4, 5, and 6. The transfer vessel may have a draft less than the draft of the port-to-port transit vessel and therefore may be operated more advantageously in the inner harbor area of a port than may the transit vessel. The transfer vessel is arranged to buoyantly engage a cargo hold unit at a transfer dock facility and to transfer the same to the vessel, and also to shift the cargo hold unit from the transfer vessel to a working dock facility. It is contemplated that a transfer vessel be considerably smaller, less powerful, and much more highly maneuverable than a transit vessel since it operates only within crowded and busy waters. Also, the transfer vessel would have minimum crew requirements. Thus, since the transfer and transit vessels serve entirely different purposes, each vessel may be tailored to meet its particular environmental, propulsion and crewing requirements, and thereby operate as effectively and efficiently as possible in its particular area of utility.

As shown best in FIG. 6, the transfer vessel has a midship section which closely resembles that of the transit vessel except as to draft. The transfer vessel has an upper deck 77 which is configured to correspond with the configuration of the bottom surfaces of cargo hold unit 22. The transfer vessel does not have vertical side walls, as does the transit vessel along the sides of center well 71. The internal spaces of the transfer vessel are subdivided to define two wing or side ballast tanks 78 and at least one central ballast tank 79 extending longitudinally of the ship and through which a tunnel 80 for propulsion shaft 81 extends from a forward machinery space 34 (see FIGS. 4 and 5). A single elongate float member 83 is disposed in each wing ballast tank. The length of each float is substantially equal to the length of cargo hold unit 22, as shown in FIGS. 4 and 5. A plurality of pillars 84 extend upwardly from each float through apertures 86 formed in the upper deck of the transfer vessel. A hold unit support pad 85 is affixed to the upper end of each pillar. The pillars cooperate in apertures 86 to guide the floats vertically within ballast tanks 78. The cross-sectional configuration of floats 83 is such as to permit the floats to be raised into abutment of the undersurface of deck 77 when tanks 78 are filled with water.

One or more sets of retractable latch dogs 87 are carried by the pillars along their length to permit the pillars to be latched or locked into place against vertical movement relative to deck 77. It is preferred that each pillar be provided with a plurality of sets of latch dogs so that the pillars may be locked relative to the vessel's hull at a number of positions of the pillars relative to deck 77. The latch dogs are retractible into the pillars by operation of a suitable mechanism (not shown) disposed within the pillars.

The total buoyancy of each float is equal to at least half the maximum weight of a loaded cargo hold unit. It will also be understood that without a cargo hold unit engaged on pads 85 the weight required to be supported by floats 83 is very slight and, therefore, with the pads unloaded, the draft of these float units in ballast tanks 78 is very slight.

As a transfer vessel enters slip 61 of a transfer dock facility to pick up a cargo hold unit supported by the dock facility over the slip, all ballast spaces of the transfer vessel are filled so that the vessel has maximum draft and so that pillars 84 are fully extended from the hull of the transfer vessel. In this condition of the transfer vessel the draft of the vessel is sufficient that the upper surfaces of pads 85 are disposed below flange surfaces 55 of the cargo hold unit which is then supported in framework 62 solely by pins 66. At this time, pillers 84 are latched from movement downwardly through apertures 86.

After the vessel has been positioned below the cargo hold unit in the transfer dock, ballast spaces 78 and 79 of the transfer vessel are pumped out, thereby causing the vessel to rise in the water and causing the weight of the cargo hold unit to be shifted from the transfer dock structure to the structure of the vessel. As soon as the weight of the cargo hold unit has been removed from all of pins 66, actuating devices 68 are operated to retract the pins away from the slip. Then, with the transfer vessel still in slip 61, ballast tanks 78 are filled and latch dogs 87 are retracted so that the entire weight of the cargo hold unit is supported buoyantly on floats 83. At this time, it is likely that the center of gravity of the combination of the transfer vessel and the hold unit will be sufficiently high that the vessel will be unstable. The vessel will not capsize, however, because the structure of the transfer dock constrains the vessel from rolling any significant amount in slip 66. The wing tanks of the transfer vessel are then pumped out to cause the hold unit to be lowered toward the hull of the transfer vessel, thereby lowering the center of gravity of the combination of the vessel and the hold unit until the combination is stable. The transfer vessel is then removed from the slip and is operated to convey the received cargo hold unit to whichever one of several working dock facilities in the port is to receive the cargo hold unit.

Upon arrival of the transfer vessel at slip 41 of working dock facility 40 (see FIG. 9), the vessel is essentially dry, whereas float units 46 are fully ballasted. In this relationship of the float units and the transfer vessel, beams 53 are disposed at a level between the underside of the cargo hold unit at flange surfaces 55 and the deck of the transfer vessel at the gunwales of the vessel. The vessel is positioned in slip 41 so that beams 53 are aligned with the spaces which exist between pads 85. The pads have a vertical dimension which is somewhat greater than the vertical dimension of the beams adjacent ends 54 thereof. After the vessel has been properly positioned in slip 41, beams 53 are extended into the spaces between the cargo hold unit and vessel deck 77. The ballast pumps of the vessel are operated to take ballast onto the vessel, whereas ballast pumps 48 of the float units are operated to increase the net positive buoyancy of the float units. By this procedure, float units 46 move upwardly relative to water surface 45 while vessel 49 moves downwardly relative to the water surface, thereby causing the weight of the cargo hold unit to be transferred from the vessel to beams 53. When the vessel has increased draft sufficiently to cause the upper surfaces of support pads 85 to be located below the undersurfaces of the beams, the transfer vessel is removed from slip 41. Float units 46 are further pumped out to increase their buoyancy until hold unit 22 is positioned relative to decks 50 so that access may be had to whichever portions of the cargo space of the hold unit are to be worked. In this regard, it is apparent from an inspection of FIG. 9 that the cargo hold unit may be raised or lowered relative to access decks 50 so that the upper or lower major cargo spaces of the hold unit may be aligned with the access decks as desired.

From the foregoing description of the transfer of a cargo hold unit from transfer vessel 49 to working dock 40, it is apparent that only minimum ballasting of the vessel is required since the dock structure includes variable buoyancy units which cooperate with the vessel to accomplish the load transfer. It will be appreciated by workers skilled in the art to which this invention pertains that this invention also contemplates a transfer dock structure which includes variable buoyancy float units, such as units 46, which may be used in a manner akin to the use described above. The result is that the ballast capacities of the transit vessel and the transfer vessel may be reduced, and the size of these vessels, particularly the transit vessel, may be determined solely by the weight of the cargo hold unit required to be transported and by the sea-state conditions which the vessel may be expected to encounter on its particular run in system 10.

In view of the foregoing, the manner in which system 10 functions to permit efficient handling and shipment of cargo should be apparent. Thus, with reference to FIG. 2, ship A is a transit vessel operating between Seattle 17 and Portland, Oregon 16. Ship B is a similar transit vessel which operates between Portland and San Francisco 15. Inasmuch as the distance by water from Portland to San Francisco is greater than the distance between Portland and Seattle, and also because different weather conditions may be expected within these two different areas, the details of ship B may be different from the details of ship A to permit the particular ships to be tailored specifically to the requirements of their runs. Similarly, ships C and D operate between San Francisco and Los Angeles 14 and between Los Angeles and San Diego 13, respectively. In no case is any one ship in this portion of system 10 required, under normal circumstances, to operate on any run different from that illustrated in FIG. 2. Since there are more cargo hold units in use in the portion of system 10 shown in FIG. 2 than there are transit vessels, the hold units may be moved from port to port only as required, or only when all cargo in the port has been loaded, or according to an established schedule. At any given port, cargo may be loaded directly into the hold unit from the vehicle which has transported the cargo from a manufacturer's factory or the like to the harbor. Thus, handling of cargo between the source of manufacture and a hold unit is minimized, and even this degree of handling may be eliminated if the working dock facility constitutes a portion of the factory of the manufacturer.

It will be further understood that at least one cargo hold unit is available in a given port at a transfer dock facility at the time of arrival of the transit vessel in that port from the next adjacent port in the system. The particular cargo hold unit which must be so available is flexible in view of the large number of hold units which may be present in the port at that time; it is preferred that there be at least two cargo hold units in port at any given time, one of which is being loaded with cargo and the other of which is being unloaded. As cargo hold units are filled at the working docks, they are transferred to the transfer dock facility in the outer harbor and are replaced by another hold unit from the transfer dock facility. It is apparent, therefore, that stevedores may work regular eight hour days, instead of odd hours, with the result that overtime wages to stevedores may be minimized. Also, the transfer vessel in a given port is engaged in productive activity almost at all times. Deliveries of cargo to the port may be scheduled for normal working hours with the result that overtime wages for teamsters and the like also are minimized.

Thus, upon arrival at Seattle, say, of transit vessel A, the vessel would deposit the cargo hold unit it has brought from Portland and would pick up a cargo hold unit as to which the working of cargo has been completed. Ship A would spend minimum time in the Port of Seattle and maximum time in transit between Seattle and Portland. Upon arrival in Portland, transit vessel A would deposit the cargo hold unit it has brought from Seattle, collect a loaded cargo hold unit at the Portland transfer dock facility and depart for Seattle, all within minimum time. Also, at Portland the crew of ship A might be changed. In this latter regard, it is apparent that the crew of ship A may live in Portland and be gone from home only that time required to make one round trip from Portland to Seattle. This means that the home life of the individuals comprising the separate crews of ship A may be as normal as possible, with the result that wages paid to such crewmen may be at a reasonable level and crew performance levels may be high.

When a southbound cargo hold unit, brought by vessel A to Portland from Seattle, has been loaded at Portland and returned to the transfer dock facility at Portland, such cargo hold unit is ready to be picked up by transit vessel B which operates between Portland and San Francisco. In this manner, a given cargo hold unit is moved from port to port through system 10 from transit vessel to transit vessel. The result is that cargo is transported efficiently via system 10 with minimum handling, minimum expense and minimum damage. Also, it is inherent in system 10 that cargo need not accumulate for long periods at dockside awaiting the arrival of a particular vessel in port. Rather, the cargo moves directly through the port to and from cargo hold units, thereby minimizing the congestion of surface traffic in the port.

In some instances, it may be desired to move a cargo hold unit from Seattle to Los Angeles, say, without working cargo to or from the unit at Portland and San Francisco. In such cases, the hold unit is not removed from the transfer dock facilities at Portland and San Francisco, but instead is picked up by vessels B and C at Portland and San Francisco, respectively, as soon as possible following arrival of vessels A and B at Portland and San Francisco, respectively. This mode of handling of a cargo hold unit may occur where all of the cargo loaded at Seattle is destined for Los Angeles, as might be the case with newsprint, for example, which might be manufactured in the vicinity of Seattle, but consumed in Los Angeles.

In commercial system 10, it is preferred that there be at least three working dock facilities in each port within the system so that, at each port, one cargo hold unit may be in a state of unloading cargo, and a second may be in a state of loading cargo. The third dock facility is open to receive the cargo hold unit which next arrives at the port from either port adjacent thereto in the system. As it is desired that there be at least two cargo hold units in any given port at any given time for maximum operating efficiency of the transport system, it is apparent that there are substantially more containers present in the system than there are ports.

This invention also permits economic and efficient transport of specialized cargos, such as citrus fruits or newsprint and the like, by sea. In order that newsprint may be handled on highspeed offset printing presses, it is necessary that the newsprint have a specified water content. If the water content of the newsprint is too high, ink will not be transferred properly to the paper; if the water content is too low, the strength of the paper is diminished and the paper may tear during passage through the printing press. The maintenance of proper moisture levels in bulk newsprint has long been a costly problem both to newsprint manufacturers and to newsprint users.

This invention, however, comprehends the provision of cargo hold units which externally would be like all other cargo hold units used in the system, but which internally would be equipped to maintain a specified environment for a specific class of cargo. Thus, for newsprint, a cargo hold unit would be equipped with moisture and temperature control machinery. Newsprint loaded onto such a cargo hold unit at Seattle, say, would be the responsibility of the manufacturer and would have proper moisture content. During transit of the cargo hold unit from Seattle to Los Angeles, say, the relative humidity and temperature within the cargo hold unit would be controlled to maintain the newsprint moisture content at optimum levels. Since the hold unit could be sealed immediately upon completion of the loading process at Seattle, the manufacturer would be assured that the newsprint would reach Los Angeles in the proper condition. At Los Angeles, the hold unit may serve as a holding warehouse for newsprint prior to its actual use by a customer newspaper, for example.

The same cargo hold unit used to transport newsprint from Seattle to Los Angeles might be used to transport citrus fruits from Los Angeles to Seattle. On the return trip to Seattle, the climate control equipment provided in the cargo hold unit would be adjusted to provide the relative humidity and temperature which is optimum for transport of citrus fruit.

Figure 7:
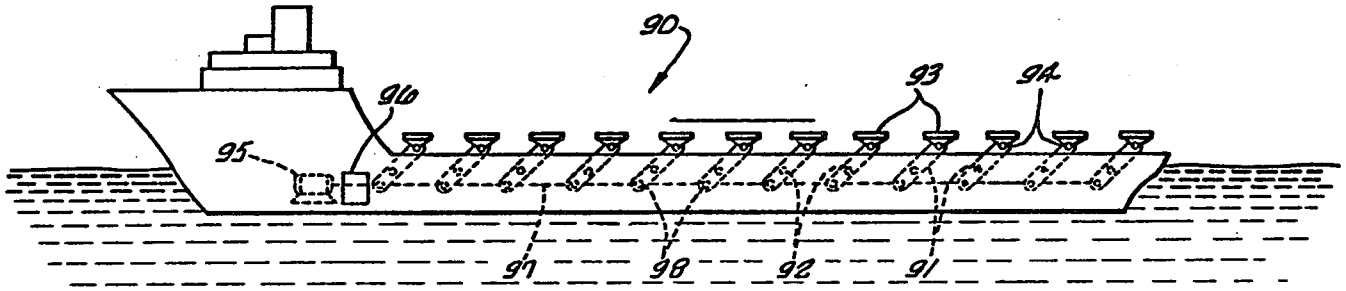
FIG. 7 is an elevation view of another in-port vessel useful in the transport system illustrated in FIGS. 1 and 2.

FIG. 7 illustrates another in-port transfer vessel 90 which may be used in the practice of this invention in lieu of transfer vessel 49, shown in FIGS. 4, 5 and 6. Vessel 90 has the same general exterior configuration as vessel 49, but does not rely entirely upon buoyancy and ballast to produce a transfer of a cargo hold unit to and from the vessel. Instead, vessel 90 includes, along opposite sides of a center well thereof (not shown), a plurality of levers 91 which are pivoted intermediate their length at 92 to the vessel hull. Each of the levers at its upper end carries a support pad 93 which is pivoted to the corresponding lever at 94. The support pads are engageable with surfaces 55 of a cargo hold unit for supporting the hold unit relative to vessel 90. The levers, all of which are essentially identical, are coupled at their lower ends to a drive motor 95 via a motion converting mechanism 96 which converts the rotation of the shaft of the motor to reciprocal motion via elongate tie rods 97 which extend along the sides of the vessel. The lower ends of the levers are pivoted at 98 to the adjacent tie rods at spaced locations along the rods. A loaded cargo hold unit may be transferred from a transfer dock facility to vessel 90, and from the vessel to a working dock facility, or vice versa, by operation of motor 95 to move the levers in tandem about pivots 92, thereby to raise or lower support pad 93 relative to the hull of the vessel.

It will be understood that it is within the scope of this invention that each of levers 91 may be provided with its own drive mechanism, in which instance all drive mechanisms would by synchronously operated so all support pads 93 are movable in tandem relative to the vessel hull. Alternatively, the separate lever drive mechanisms may be differentially operated to impart a desired angle of longitudinal or transverse inclination to a cargo hold unit as it is positioned in a working dock facility for the purposes described above. It is also within the scope of this invention that the mechanically operated structure illustrated in FIG. 7 may be used in conjunction with ballasting of the vessel. That is, it is within the scope of this invention that the relative movement between a cargo hold unit and the hull of a transfer vessel may be produced solely by ballasting operations or by mechanical processes, or by a combination of ballasting and mechanical processes.

It was mentioned above, in conjunction with a description of flooding duct 72 of transit vessel 20 shown in FIG. 3, that cargo hold units 22 preferably have watertight integrity at least over their lower extremity such that the hold units themselves may be floated. This feature of the hold units adapts them for use as barges. Such capability of a hold unit is particularly significant where transport system 10 is to serve not only the seaboard coasts of the United States, but also the Mississippi River complex 100, for example (see FIG. 1). Accordingly, system 10 may include a transit vessel 20 for operation between New Orleans, Louisiana 101 and St. Louis, Mo. 102, for example. From St. Louis, cargo hold units may be moved in the upper Mississippi River 103 along the Missouri River 104 or the Ohio River 105, for example, by existing push-type river towboats exemplified by the vessels manufactured by Dravo Corporation. Such towboats may be used to maneuver either a single cargo hold unit or a raft of hold units lashed together in the same manner as river barge flotillas are assembled at the present time. Alternatively, cargo hold units may be moved from New Orleans to and from St.

Louis by riverboats instead of by transit vessels, if desired.

Figure 16:
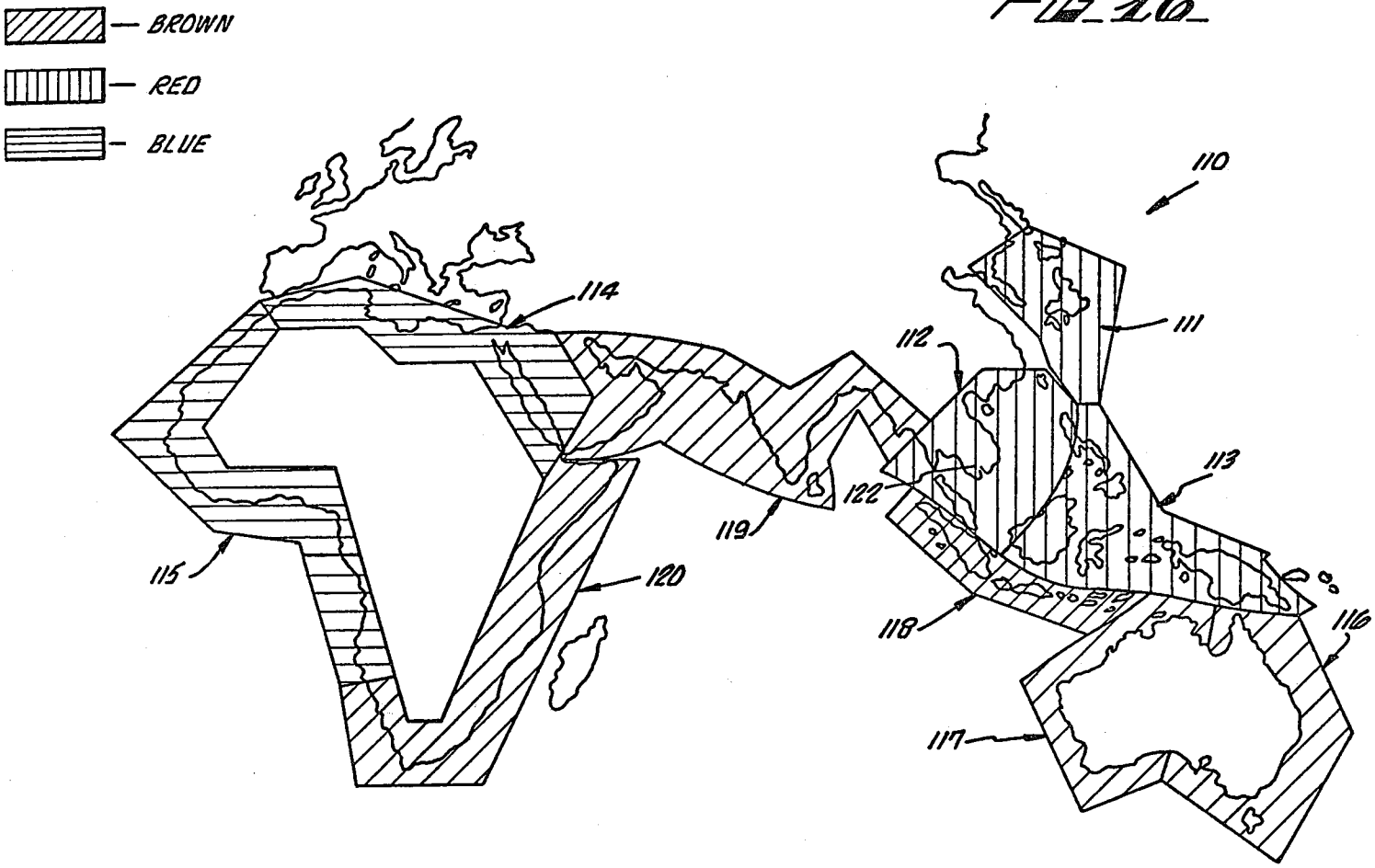
FIG. 16 illustrates a military transport and logistical support system according to this invention.
Figure 11:
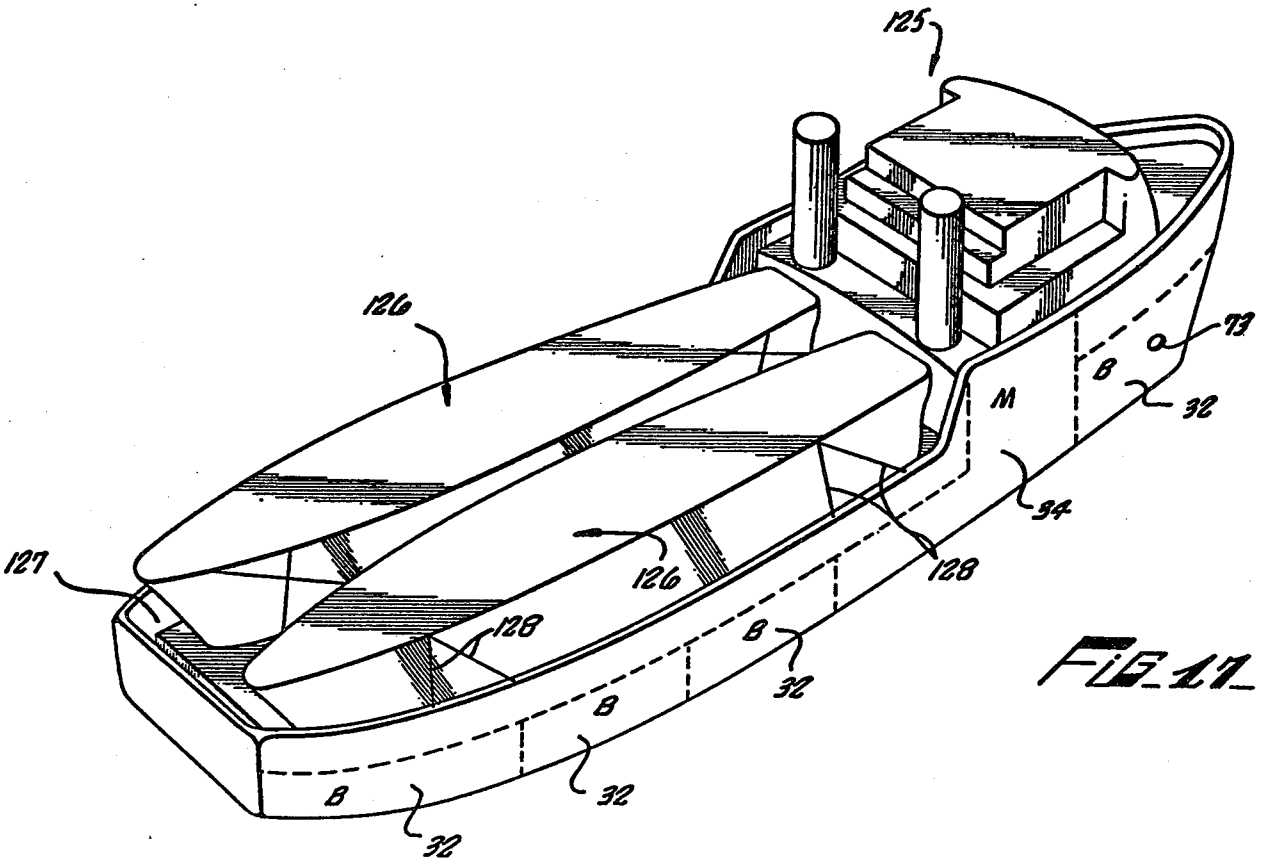

FIG. 16 illustrates the operation within the Eastern Hemisphere of a military transport and logistical support system 110 which is also a part of this invention. It will be understood that system 110 may be used on a worldwide basis; only the Eastern Hemisphere is shown in FIG. 16 for the purposes of simplicity of illustration. The vessels shown in FIGS. 3, 17 and 18 are useful in system 110, as will be made apparent from the following description.

The portion of military system 110 which is shown in FIG. 16 is divided into several subsystems. The subsystems include three subsystems 111, 112 and 113 (the territory of each of which is cross-hatched in FIG. 16 to correspond to red coloration), two subsystems 114 and 115 (the area of which is cross-hatched to correspond to the color blue), and five additional subsystems 116, 117, 118, 119 and 120 (each of which is indicated by a cross-hatched area corresponding to the color brown). Subsystems 111, 112 and 113 are designated as 400-1 subsystems, subsystems 114 and 115 are designated as 800-2 subsystems, and the remaining systems are known at 1200-3 subsystems. The significance of this subsystem nomenclature will be explained below.

For the purposes of explanation, attention is directed initially to subsystem 112 of the 400-1 type. In any subsystem, regardless of its type, a base port of operations is established within the territory of the subsystem. In the case of subsystem 112, the base port has been assumed to be established at Saigon, South Vietnam 122. Within the territory served by each subsystem, a selected number of additional subsidiary ports, to be supplied with military materiel, are established. In the case of subsystem 112, fourteen additional ports are established at locations within the confines of the subsystem at locations which are not identified in FIG. 16.

For a type 400-1 subsystem, the subsidiary ports are located approximately 400 miles apart from each other, 400 miles being the distance which a single hold unit transit vessel, constructed substantially in accord with FIG. 3 and the foregoing description, may sail in one day. Thus, the term "400-1" applied to subsystem 112 means that the ports within the subsystem are 400 miles apart and can be serviced within one day from any adjacent port in the subsystem. The ports in subsystem 114, for example, are located 800 miles apart and are serviceable within two days from adjacent ports. The ports in system 119, for example, are 1200 miles apart and are serviceable within three days from adjacent ports within the subsystem.

Still referring to subsystem 112 for illustrative purposes, fourteen single hold unit transit vessels of the basic type shown in FIG. 3 are utilized in the subsystem to shuttle hold units back and forth throughout the system from port to port in much the same manner as has been described above relative to commercial system 10. A plurality of cargo hold units 22 are also utilized in subsystem 112. Preferably 44 containers are present in the subsystem during normal conditions.

Each subsystem within military system 110 also includes at least one of either of the transit vessels shown in FIGS. 17 and 18, such vessel being maintained primarily at the base port within the subsystem. Each single cargo hold unit present in the system has the capacity for carrying at least 5000 tons of cargo, it being preferred that the cargo hold units utilized in any military system according to this invention be of the same basic size as, and be interchangeable with, the cargo hold units of any commercial transport system established pursuant to this invention.

Transit vessel 125, shown in FIG. 17, is similar to transit vessel 20, shown in FIG. 3, but is sufficiently larger than vessel 20 that it may accommodate two cargo hold units 126 in side-by-side relation in the aft portion of the transit vessel. The cargo hold units shown in FIG. 17 are illustrated as being of hull-form configuration rather than of rectilinear configuration for the purpose of illustrating the versatility of the invention; in this regard see my prior U.S. Pat. Nos. 3,139,197 and 3,349,742. It will be realized that the cargo hold units transportable by transit vessel 125 may be of the same basic configuration as cargo hold units 22, without departing from the scope of this invention. Regardless of the external configuration of the cargo hold units transported by vessel 125, the hold units are secured in place in the center well 127 of the vessel by suitable stays and struts 128 (shown schematically) to prevent the hold units from shifting relative to the transit vessel during transocean operation of the vessel or during operation of the vessel within subsystem 112, for example. As with transit vessel 20, the interior spaces of transit vessel 125 define ballast spaces 32 and a machinery space 34.

Transit vessel 130, shown in FIG. 18, is essentially an enlarged version of vessel 125 and is sufficiently large to be able to carry four cargo hold units 22 arranged in two-by-two relation. As noted above, FIG. 18 illustrates that any port-to-port transit vessel according to this invention may be fitted with a transom gate 74 to facilitate removal of the cargo hold units from the transit vessel. In the case of transit vessels 125 and 130, an aft transom gate is desirable so that cargo hold units may be floated from the center well of the vessel; the side-by-side relationship of the cargo hold units on such vessels makes it difficult, if not impossible, to remove the cargo hold units from the vessels by use of the transfer or working dock facilities described above. That is, the transfer docks and working dock facilities according to this invention are configured to cooperate with either an in-port vessel or a transport vessel arranged for carrying only a single cargo hold unit. Vessels 125 and 130 have beams greater than the width of the slips associated with these docking facilities and therefore these vessels necessarily incorporate loading and unloading features not present in the single hold unit vessels. Each of vessels 125 and 130, therefore, defines sufficient ballast space that the vessels may be ballasted by the stern an amount adequate to enable the cargo hold units to be floated into and out of the center wells of such vessels. In order that cargo hold units 22 or 126 may be floated into and out of the center wells of vessels 125 and 130, each of these vessels is fitted with forward flooding ducts, only the outboard opening 73 thereof being shown in FIGS. 17 and 18.

FIG. 19 illustrates that, in cross-section, the center well of vessel 130 is configured to cooperate with hold units 22 to secure the hold units from shifting within the vessel. That is, the center well of vessel 130 defines two parallel longitudinal recesses 131 on opposite sides of a centerline longitudinal projection 132 from the inner bottom of the vessel hull. Cargo hold unit ribs 30 mate within recesses 131.

FIGS. 3–5, 17 and 18 also illustrate that it is preferred that any port-to-port or transocean transit vessel provided in any transport system according to this invention be arranged with the machinery, crew and navigation spaces located forward rather than aft on the vessel. Such location of the navigation spaces is preferred in order that visibility over the bow from the bridge may be maximized, thereby minimizing operational hazards during use of the vessels, particularly where the vessel is operating in close waters as in a river or a harbor.

Returning again to FIG. 16, and particularly subsystem 112 thereof, the subsystems are serviced from the United States, for example, by multiple cargo hold unit transit vessels 125 or 130. Each subsystem has however many vessels 125 or 130 associated with it as is deemed prudent by the responsible military authority, but it is anticipated that the distance from the home supply port to the subsystem and the expected cargo requirements of the subsystem will be the principal factors determining the number of such vessels as may be used with any one subsystem at any given time.

It was noted above that the supply of cargo to the several ports in subsystem 112 is carried out on much the same basis as cargo is handled in commercial system 10, described above. That is, during normal or quiet conditions within the territory serviced by the subsystem, single cargo hold unit transit vessels operate on established schedules between the various ports of the subsystem to move cargo hold units throughout the subsystem to and from base port 122. Multiple cargo hold unit transit vessel 125 or 130, whichever is used, patrols the subsystem territory on a standby basis. In the event of an incident of military significance within the subsystem territory, such that the supply requirements of a particular port within the subsystem are suddenly increased, 5000 to 10,000 tons of cargo may be supplied to that port in the first day from each of the ports adjacent thereto within the subsystem. At the time of occurrence of the incident, all other transit vessels in the subsystem would be given orders to sail to the port of particular interest. Thus, on the second day, an additional 10,000 to 20,000 tons of cargo would reach the port of particular significance; on the third and succeeding days (for up to twenty-eight days following the incident) 5000 tons of cargo per day could be delivered to the port. At any time between the first and the tenth day following the incident, a four-unit transit vessel would deliver 20,000 tons of cargo to the port from the basic supply location of the entire system. On the thirty-second day following the incident, the subsystem would still have 50,000 tons of cargo in reserve within its own territory. Individual single unit transit vessels may return to home bases in the United States for restocking, beginning within the twelfth day. Reserve multiple hold unit transit vessels would also be dispatched from the United States, for example, immediately upon the occurrence of the incident. If the incident has critical military significance, the transit vessels used in commercial transport system 10 could be called into service in support of military system 110 to transfer additional supplies of military equipment to the territory of subsystem 112. All this support of subsystem 112 would leave the other subsystems undisturbed and functioning according to their normal schedules of operation.

Thus, during normal conditions in subsystem 112, 240,000 tons of cargo is present in the territory encompassed by the subsystem. Assuming that the subsystem has the characteristics described above, and that each cargo hold unit within the subsystem is capable of containing 5000 tons of cargo, there would be two hold units in each of fifteen ports, for a total of 150,000 tons of cargo. Fourteen single hold unit vessels in movement between the various ports of the subsystem account for an additional 70,000 tons of cargo. The remainder of the cargo within the system is assumed to be present on a four-unit transit vessel 130 patrolling the subsystem territory. In summary, therefore, 150,000 tons of cargo is present at all times in the various ports of the subsystem, and 90,000 tons of cargo is in motion within the subsystem.

Further, by way of example relative to military transport system 110, it is proposed that each of the type 800-2 subsystems might contain eight ports (one of which is a base port), seven single-unit transit vessels, and twenty-three 5000 ton cargo hold units, for a total subsystem cargo capacity of 135,000 tons. A type 1200-3 subsystem, such as subsystem 119 might include five ports (one of which is a base port), four single-unit transit vessels, and fourteen containers, for a total cargo capacity within the subsystem of 90,000 tons.

Obviously, the type of subsystem established in any given geographical area within the ambit of system 110 will be dependent upon the military evaluation of the significance of the area, the normal requirements of the subsystem for military supplies, and, probably most importantly, the potential for the occurrence of an incident of military significance at some location within the subsystem. Thus, it will be readily understood that the arrangement and types of subsystems illustrated in FIG. 16 and described above have been presented merely by way of example. It should also be understood that the number of ports, the number of containers, the number and types of transit vessels used in any subsystem may also be varied without departing from the scope of the present invention.

Figure 14:
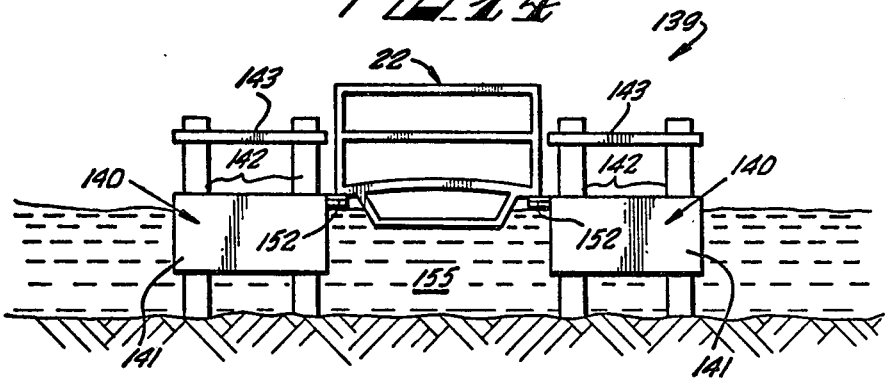
FIG. 14 is an end elevation view of the structure shown in FIG. 13 showing a cargo hold unit engaged with the dock.

In order that subsidiary ports may be established at desired locations in any military transport system according to this invention, and also so that the benefits inherent in the commercial system described above may be realized at substantially any place, particularly in areas where no ports are naturally available or are required on a temporary basis, this invention provides an improved transportable dock facility (see FIGS. 10–15). A complete portable dock facility 139, as shown in FIG. 14, includes a pair of floatable dock units 140, shown best in FIGS. 10 and 11. Each dock unit includes a rectilinearly configured, ballastable, buoyant base 141, four vertically disposed cylindrical piers 142 located one adjacent each of the four corners of the base, and an elevatable access deck structure 143. The internal volume of base 141 is subdivided both longitudinally and transversely to define a plurality of ballast tank spaces 144. Ballast pumps and manifolding 145 and a suitable drive mechanism 146, such as a diesel engine, are located within the base and are operable for moving water ballast to or from the ballast tank spaces, thereby to vary the buoyancy of the base.

Each pier 142 is disposed within a tubular sleeve 148 which extends from top to bottom through the base adjacent each of the four corners of the base. The piers are vertically movable relative to the base and are guided in such movement by suitable bearings 149 engaged between the pier and the base at the opposite ends of sleeves 148. A plurality of apertures are formed along the length of each pier adjacent the upper end thereof at diametrically spaced locations to receive locking pins (not shown) for positioning deck 143 at desired locations along the length of the piers in the manner described below.

Figure 10:
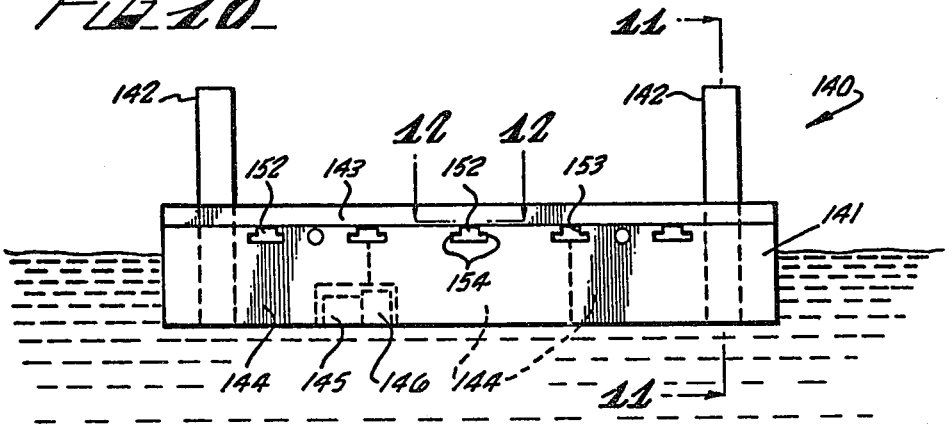
FIG. 10 is a side elevation view of a portable working dock facility according to this invention.
Figure 11:
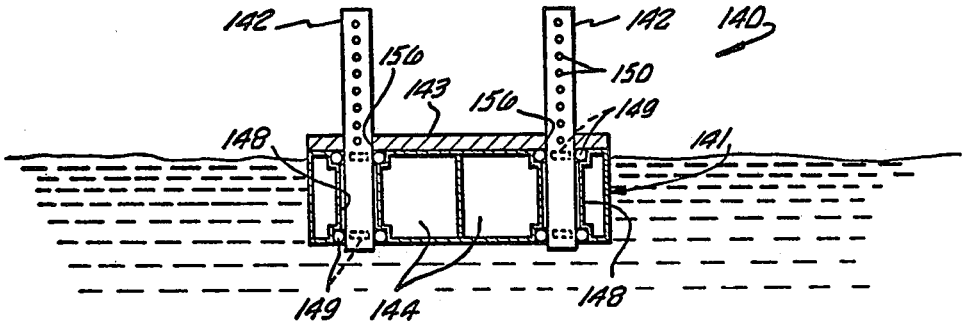
FIG. 11 is a cross-sectional elevation view taken along line 11—11 of FIG. 10.
Figure 12:
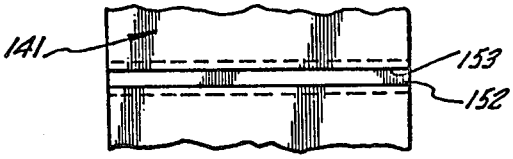
FIG. 12 is an enlarged fragmentary plan view taken along line 12—12 of FIG. 10.
Figure 13:
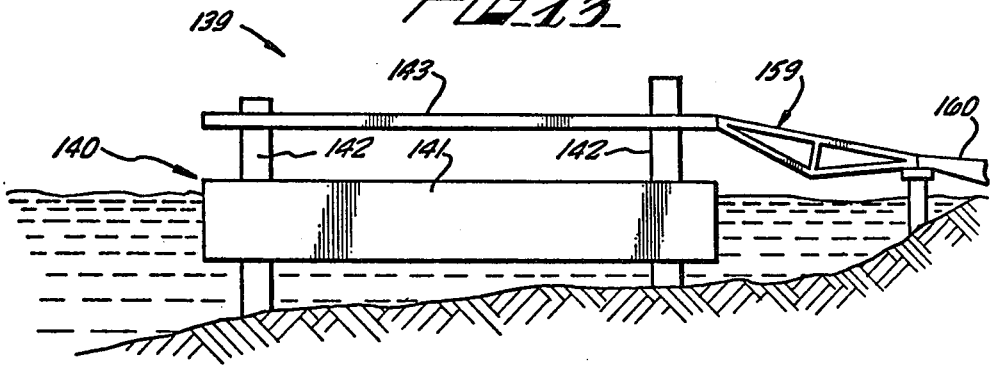

A plurality of cargo hold unit support beams 152 are movably mounted to the upper portion of the base at spaced locations along the length of the base. As shown in FIG. 12, the beams extend transversely of the width of the base and preferably are housed in receiving grooves 153 formed in the upper surface of the base. FIG. 10 illustrates that it is preferred that the beams and their grooves be configured so that the beams have a mortise and tenon type connection to the base. That is, lateral flanges 154, extending fore and aft of the base, are formed along each side of the beam below the upper surfaces thereof such that the beams have an inverted T cross-sectional configuration; grooves 153 are configured to slidably mate with the external surfaces of the beams so that, when the beams are extended laterally of base 141, as shown in FIG. 12, the beams have a secure cantilever support on the base and readily support a cargo hold unit received in a slip 155 defined between adjacent dock units in the completed dock facility (see FIG. 14).

Figure 15:
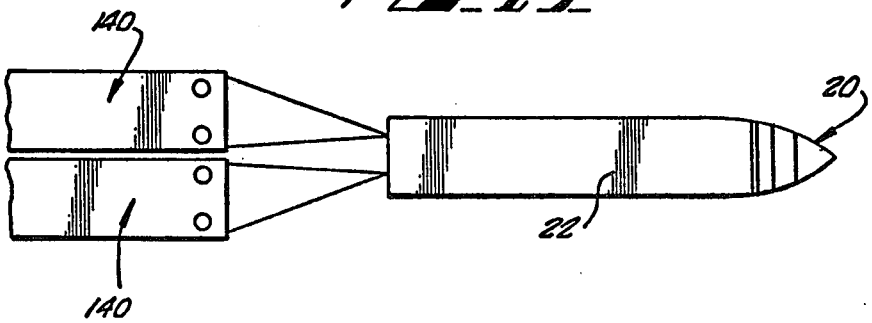
FIG. 15 is a top plan view of a transit vessel, fitted with a cargo hold unit, towing a pair of portable working dock structures.

Dock units 140 are towable to the site of intended installation by a transit vessel 20, if desired, as shown in FIG. 15. In movement to the site of use, the dock units are in the condition shown in FIGS. 10 and 11, with the piers elevated relative to bases 141 and with decks 143 received upon the upper surface of the bases. Upon arrival at the location where the dock is to be installed, the bases are moved as close as possible to the shore consistent with the draft of the vessels which are required to be serviced by the completed dock. Piers 142 then are moved downwardly relative to the bases into firm engagement with the ocean bottom. Since the piers are independently vertically movable relative to bases 141, the piers may be positioned to accommodate any irregularities in the ocean floor. That is, it is not necessary that the upper ends of the piers be coplanar with each other. Once the piers are securely footed on the ocean bottom, decks 143 are raised along the piers to the desired elevation and are secured at such locations relative to the piers by insertion of pins in those aligned apertures 150 which lie just below the undersurfaces of the decks. The pins, which are passed through the piers, have lengths greater than the diameters of the piers. Suitable ramps or gangways 159 are then installed between the shoreward ends of decks 143 and either the shore or a causeway 160 or the like built out to the dock facility from the shore.

The opposite longitudinal edges of decks 143 may mount retracting pin assemblies (not shown, but see pin assemblies 66, 68 of FIG. 8, for example) at such locations as to cooperate with sockets 67 in the side walls of cargo hold unit 22 for holding a cargo hold unit stationary relative to piers 142 until a transit vessel has moved sufficiently clear of the cargo hold unit to enable beams 152 to be moved into engagement with the marginal undersurfaces of the cargo hold unit as shown in FIG. 14. Obviously, if desired, retractable support pins may be mounted to the upper surfaces of ballastable bases 141 in much the same manner as corresponding structures are mounted to piling arrays 59 shown in FIG. 8. It is apparent that retractable support pin provision must be made in the structure of dock facility 139 only if it is desired to transfer a cargo hold unit to the dock directly from a transit vessel rather than from a vessel having a configuration similar to vessel 49, shown in FIGS. 4, 5, and 6.

The ballasting machinery provided in portable dock bases 141 enables the bases to be moved vertically along piers 142 for the purposes of transferring a cargo hold unit to or from a transfer vessel or a transit vessel, as well as for adjusting the position of the several possible internal decks of a cargo hold unit vertically and angularly relative to decks 143.

As is the case with the structure shown in FIG. 9, piers 142 serve basically as supports for decks 143 and as guides for bases 141.

The use of automatic or semi-automatic cargo handling equipment in cargo hold unit 22 has been mentioned above. The specific reference made above was to gravity-powered roller-type conveyors within the cargo hold unit. It is within the scope of this invention that power-driven roller or belt-type conveyor mechanisms, either of the floor-mounted or overhead type, may be used within the cargo hold unit as desired. The use of such automatic cargo handling and conveying equipment in the cargo hold unit is particularly desirable where the cargo hold unit is to be used essentially only with one type of cargo, as in the transport of newsprint or bananas, for example.

Figure 20:
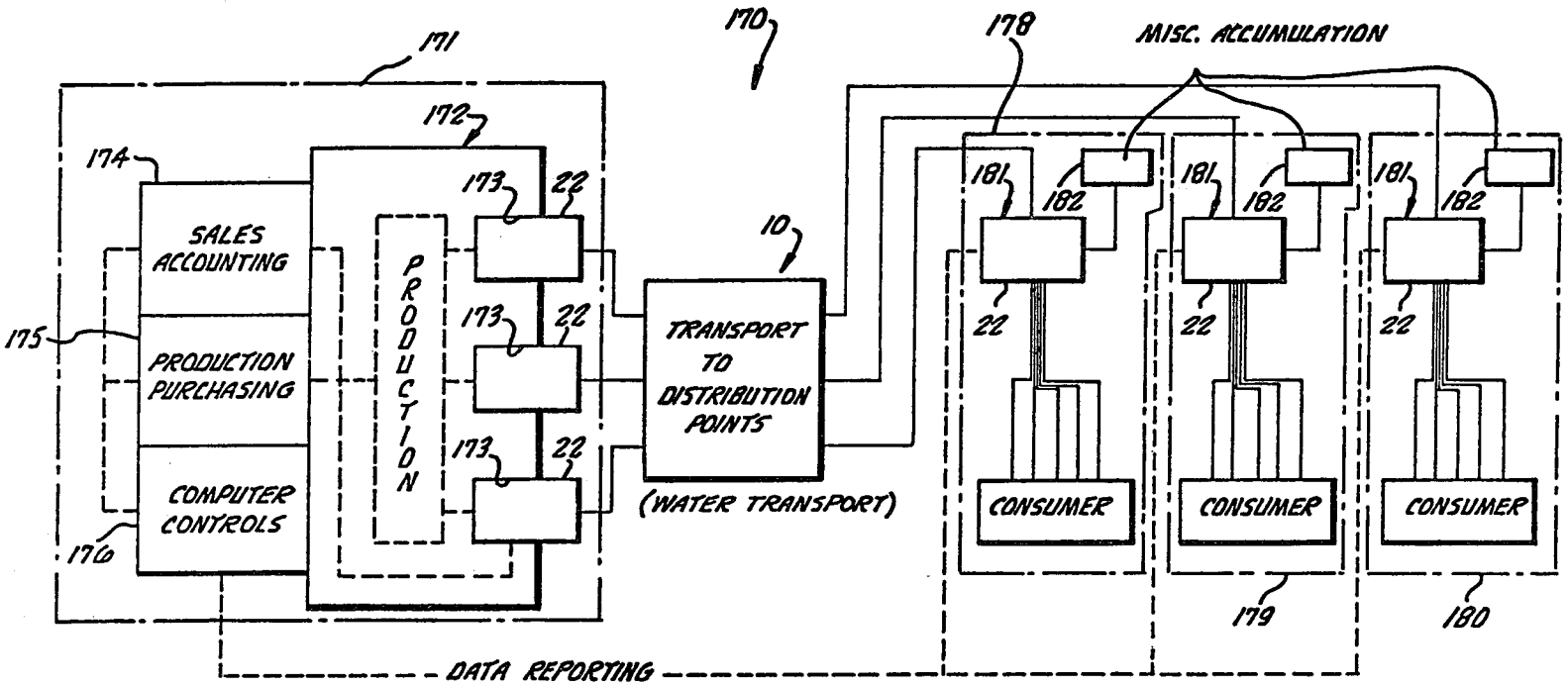
FIG. 20 is a schematic diagram of a manufacturing and marketing system incorporating the marine transport system illustrated in FIGS. 1 and 2, for example.

FIG. 20 illustrates in a schematic manner how a manufacturing operation may be integrated into commercial transport system 10 for optimum supply of goods to the market place at minimum cost to the ultimate consumer. That is, FIG. 20 is a schematic representation of the functional relationships present in an integrated manufacturing and distribution operation 170 which incorporates commercial transport system 10. In FIG. 20, the area within phantom line 171 (— ..— .. —) represents a manufacturing facility located on a river or within a harbor serviced by transport system 10. The manufacturing facility includes a factory 172 built around a plurality of working dock facilities 173 (similar to the structures shown in FIG. 9, for example) for in-port transfer vessels 49 and cargo hold units 22. The factory also includes an area 174 for sales and accounting functions, an area 175 for purchasing and production control functions, and an area 176 for a data processing function to which information concerning production, sales and consumer requirements is supplied. Factory 172 may be a brewery, for example.

In FIG. 20, the areas within phantom lines 178, 179 and 180 designate product distribution and customer service facilities in remote cities. Each of facilities 178,179 and 180 is located within a port serviced by system 10 and includes a working dock facility 181 for a cargo hold unit 22. Each of the cargo hold units used in integrated operation 170 preferably is equipped with automatic cargo handling equipment of the type which has been described in prior patent literature and is within the present state of the materials-handling art. The cargo hold units in remote facilities 178,179 and 180 are utilized during the time the hold units are present at such facilities, as warehouses from which requirements of customers of the brewery are supplied as needed.

As goods are removed from the cargo hold units located remote from brewery 172, the nature and quantity of such goods, and the identity of the customer to whom such goods are distributed, are reported to the data processing function within factory 172. Such data may be transmitted readily to the brewery by inserting a punched card into a card reader at service facility 178, for example. Data concerning the quantity and nature of the goods may be pre-punched onto the card and such card affixed to the goods at the factory and the identity of the consumer may be added to the card at facility 178 before the card is read during the data transmission process. Upon receipt of this data at the brewery, the sales and the accounting functions are appropriately advised; the production and purchasing function at the brewery is also advised so that the production of additional goods may be scheduled.

After an appropriate time peculiar to the particular product involved in integrated operation 170, it will have been ascertained that the supply of goods present in the cargo hold unit at service facility 178, for example, requires replenishment. Accordingly, at the factory, appropriate information is generated to cause a cargo hold unit to be loaded with appropriate goods for dispatch to service facility 178. The cargo hold unit then will be dispatched to service area 178 via common carrier transport system 10, or, alternatively, by a transit vessel owned by the brewery itself.

Prior to the arrival of a fully loaded cargo hold unit at service point 178 from factory 172, any product remaining in the hold unit already at such facility is removed to a miscellaneous accumulation area 182, and the empty cargo hold unit is removed so that a loaded replacement hold unit may be inserted in its place.

At each of service distribution facilities 178, 179 and 180, the cargo hold unit functions as an automated warehouse. By means of data processing equipment connected between these facilities and the remote manufacturing operation, precise and efficient control over sales, accounting and production operations may be obtained quite readily and economically. The consumers in these remote areas are provided with the goods they require at the time such goods are required.

The foregoing text contains a description of the use of an in-port transfer vessel for the purposes of shuttling cargo hold units between a transfer dock facility located in an outer harbor and a working dock facility located in an inner harbor. In the case of Astoria and Portland, Org., for example, the transfer dock facility may be located at Astoria and the working dock at Portland. The transfer vessel would shuttle the hold units between Portland and Astoria along the Columbia River. Transit vessels operating in system 10 in the vicinity of Portland would not be required to negotiate the river upstream of Astoria. This particular situation clearly illustrates the versatility of the commercial system heretofore described and the benefits which flow from use of such system.

In view of the foregoing description, it is apparent that marine transportation systems 10 and 110 make it possible for the cargo units described above to be treated in much the same manner that railroad flatcars, gondola cars, tank cars or box cars are processed. The economic advantage of a railroad is that the expensive locomotives and diesel engines used by the railroads are kept constantly in motion for the purposes of moving cargo units from place to place and are not tied up in an idle condition, like the conventional ship, while the cargo carrying units are being loaded or unloaded. This invention allows the expensive vessels 20, 49, 90, 125 or 130, described above, to be kept in service for a maximum portion of their useful life in actually moving cargo from port to port, rather than sitting idle in the port as cargo is loaded into or out of the hold units. This invention also makes it possible for the hold units to be loaded or unloaded over extended periods during normal working hours.

It should also be apparent from the foregoing description that the transfer vessels or the ballastable units of a working dock may be operated separately or in cooperation with each other to adjust the position of a hold unit in the dock either in trim or heel as well as vertically relative to the dock structure.

In the foregoing description of commercial system 10 and of military system 110, the cargo hold units were referred to in a manner which might suggest that these units are arranged for transporting only cargo. It is within the scope of this invention that the modular load-carrying units referred to above as cargo hold units may also be arranged internally to define habitable spaces. This feature of the invention is particularly significant with respect to the military system previously described in that it enables rapid and efficient provision, at substantially any place desired, of a complete military base, including personnel and support material. Similarly, a cargo hold unit may be fitted internally to define a small factory or the like; a manufacturing operation may be fabricated essentially complete in the United States and transported intact to a so-called emergent or underdeveloped country. The utility of specially equipped hold units should also be apparent with respect to natural disasters such as tidal waves, hurricanes, earthquakes and the like, where schools, hospitals, homes and food supplies may be destroyed.

In view of the foregoing description and the accompanying illustrations, it is apparent that this invention provides an improved commercial marine transport system which may be used to advantage in both domestic and international trade. Moreover, the invention provides an improved military transport and logistical support system which is compatible with, and in fact may rely upon, the commercial system. The invention also provides improved structures pursuant to which the benefits of the commercial and military systems may be realized.

It should be understood that the specific systems and operations described above have been set forth merely by way of example to illustrate the features and benefits provided by this invention. Specific structural arrangements have been set forth by way of example; each such arrangement may be varied to incorporate the features of other disclosed arrangements without departing from the scope of this invention. In short, then, the foregoing description of numerous examples and illustrative structures has been presented in furtherance of a comprehensive and complete description of the invention rather than for purposes of limitation of the invention.

What is claimed is:

1. A method of transporting cargo by water comprising the steps of (a) providing a plurality of modular cargo hold units of generally uniform external configuration and dimension over at least the lower portions thereof, (b) establishing an overall route over which cargo is to be moved so that the route includes at least three ports, and subdividing the route into subroutes which connect each adjacent pair of ports in the overall route so that at least one port is the terminus for two adjacent subroutes, (c) providing for each subroute a self-propelled shuttle vessel configured to mate with and to support at least any one of the hold units, each shuttle vessel being sized relative to a hold unit such that a loaded hold unit constitutes a substantial fraction of the load-carrying capacity of the vessel and each vessel being configured and arranged for operation along its subroute, (d) providing in each port a dock facility arranged for receiving and supporting a hold unit independently of any of the vessels, (e) loading into a hold unit at an originating port only cargo destined for a given different non-adjacent destination port in the overall route, (f) moving a loaded hold unit between the originating port and the destination port on the route via one or more intermediate ports by (i) moving the hold unit by a first shuttle vessel along a first subroute from the originating port to a first intermediate port, (ii) transferring the hold unit from the first shuttle vessel to the dock facility in the first intermediate port, (iii) transferring the hold unit from the dock facility in the first intermediate port to a second shuttle vessel for the subroute which is adjacent the first subroute, and (iv) moving the hold unit toward the destination port by operating the second vessel along its subroute and by repeating steps (ii) and (iii) above in each intermediate port between the first intermediate port and the destination port so that the hold unit is moved along each subroute between the originating and destination ports by the shuttle vessel for each subroute, and (g) removing from a hold unit cargo contained therein only on arrival of the hold unit at the destination port for which all cargo in the hold unit is destined.

2. A method according to claim 1 including transferring the cargo hold units between the vessels and the dock facilities by relative ballasting between the vessels and the dock facilities.

3. A method according to claim 2 wherein said transferring procedure is performed solely by ballasting of the vessels.

4. A method according to claim 2 wherein said transferring procedure is performed by ballasting of the vessels and of buoyant components of the dock facilities.

5. A method according to claim 1 wherein the dock facility of at least one of the ports defines a working dock arranged for the working of cargo to and from a received cargo hold unit and a transfer dock located separate from the working dock, defining the terminus of the subroutes associated with the one port at the transfer dock, providing in and assigning to each said at least one port a transfer vessel arranged for receiving a hold unit from either the transfer dock or the working dock, for supporting a received hold unit, and for transferring a received hold unit to either the transfer dock or the working dock, and operating the transfer vessel only in and in association with its assigned port to transfer cargo hold units between the transfer dock and the working dock.

6. A method according to claim 5 wherein the dock facilities of each port define a transfer dock and a working dock, and including providing a transfer vessel in each port.

7. A method according to claim 6 including providing at least three working docks in each port.

8. A method according to claim 5 including constructing the transfer vessel to define internal float means of buoyancy sufficient to support the weight of a loaded cargo hold unit, means for buoyantly raising and lowering the float means relative to the transfer vessel hull, and means carried by the float means for supportively engaging a hold unit, and transferring a hold unit to the transfer vessel from a transfer dock or a working dock by ballasting the vessel to increase the draft thereof and to raise the float means in the transfer vessel, positioning the transfer vessel under the hold unit to be transferred, locking the float means in an upward position relative to the transfer vessel, unballasting the transfer vessel to raise the same into load supporting engagement with the hold unit, removing such vertical support of the hold unit as may exist independently of the transfer vessel, reballasting the transfer vessel to buoyantly support the float means in the transfer vessel, unlocking the float means relative to the transfer vessel, and unballasting the transfer vessel to lower the float means in the vessel and to transfer the weight of the hold unit directly to the hull structure of the transfer vessel.

9. A method according to claim 1 wherein at least one of the subroutes is substantially longer than the subroutes nextadjacent thereto, and providing means for moving a plurality of cargo hold units simultaneously along the subroute.

10. A method according to claim 9 wherein the shuttle vessels for all subroutes are each arranged for supporting and moving a single cargo hold unit, and providing a plurality of shuttle vessels for the one subroute.

11. A method according to claim 9 wherein the shuttle vessels associated with subroutes other than the one subroute are each arranged for supporting and moving a single cargo hold unit, and providing for the one subroute a shuttle vessel arranged for supporting and moving a plurality of cargo hold units.

12. A method according to claim 1 including locating the dock facility of one port along the overall route substantially within a manufacturing establishment, loading products manufactured by said establishment essentially directly into a hold unit supported at the adjacent dock facility, defining the dock facility of another port along the overall route as a product distribution center for the manufacturing establishment, moving a loaded cargo hold unit from the manufacturing establishment to the distribution center according to the procedure aforesaid, and distributing products essentially directly from the hold unit at the distribution center.

13. A method of establishing and operating a military logistical support operation by water comprising the steps of (a) defining a geographical area of interest within which a logistical support system is to be operated, (b) establishing within the area a base port and a plurality of secondary supply ports, and an overall route over which cargo is to be moved so that the route is comprised of a plurality of subroutes each of which connects an adjacent pair of ports and at least one of the ports is a terminus for two adjacent subroutes, there being at least two subroutes in the route between at least one of the secondary ports and the base port, (c) providing at least as many standardized modular cargo hold units as there are total ports established in the defined area, the hold units being of generally uniform external configuration and dimension over at least the lower portions thereof, (d) providing at least as many self-propelled hold unit shuttle vessels as there are subroutes established in the defined area, the shuttle vessels each being arranged to mate interchangeably with and buoyantly support a hold unit, each shuttle vessel being sized relative to a hold unit such that a loaded hold unit constitutes a substantial fraction of the load-carrying capacity of the vessel, (e) during normal conditions within the defined area operating the vessels and the hold units by a procedure which includes the steps of (i) assigning each shuttle vessel to a specific subroute to operate back and forth between the ports constituting the termini of the specific subroute, (ii) dispatching from the base port to each secondary port in the area loaded hold units each containing cargo and the like destined only for a particular destination secondary port, (iii) moving the loaded hold units from the base port to corresponding destination secondary ports via the shuttle vessels assigned to the subroutes terminating at the base port and, in the case where a destination secondary port is removed from the base port by a plurality of subroutes and at least one intermediate secondary port, by (1) transferring the hold unit in a first intermediate secondary port nearest the base port from a first shuttle vessel assigned to the subroute of which the base port is a terminus to a second shuttle vessel assigned to the next subroute toward the destination port, (2) moving the hold unit toward its destination port by operating the second shuttle vessel along its subroute, and (3) repeating steps (1) and (2) above in each additional intermediate secondary port between the first intermediate port and the destination port so that the hold unit is moved along each subroute between the base port and the destination port by the shuttle vessels for the respective subroutes, and (iv) removing from a hold unit cargo and the like contained therein only on arrival of the hold unit at its destination port for which all cargo therein is destined, and (f) during abnormal conditions in the defined area during which a particular port in the area has special significance and supply requirements, supplying the particular port from the remaining ports in the area via shuttle vessels other than the shuttle vessels normally associated with the particular port.

* * * * *